US005286620A

United States Patent [19]

Ohkawa et al.

[11] Patent Number: 5,286,620

[45] Date of Patent: Feb. 15, 1994

[54] SILVER HALIDE COLOR PHOTOGRAPHIC MATERIAL

[75] Inventors: Atsuhiro Ohkawa; Masuji Motoki; Keiji Mihayashi, all of Kanagawa, Japan

[73] Assignee: Fuji Photo Film Co., Ltd., Kanagawa, Japan

[21] Appl. No.: 655,605

[22] Filed: Feb. 15, 1991

[30] Foreign Application Priority Data

Feb. 16, 1990 [JP] Japan ..... 2-37070

[51] Int. Cl.[5] ..... G03C 7/32; G03C 7/36; G03C 7/38

[52] U.S. Cl. ..... 430/544; 430/543; 430/957

[58] Field of Search ..... 430/544, 957, 505, 382

[56] References Cited

U.S. PATENT DOCUMENTS

| | | | |
|---|---|---|---|
| 4,698,297 | 10/1987 | Ichijima et al. | 430/544 |
| 4,861,701 | 8/1989 | Burns et al. | 430/544 |
| 4,962,018 | 10/1990 | Szajewski et al. | 430/544 |

FOREIGN PATENT DOCUMENTS

| | | | |
|---|---|---|---|
| 0354532 | 2/1990 | European Pat. Off. | 430/544 |
| 217242 | 9/1987 | Japan | 430/544 |
| 291645 | 12/1987 | Japan | 430/544 |
| 243058 | 9/1989 | Japan | 430/544 |

*Primary Examiner*—Richard L. Schilling
*Attorney, Agent, or Firm*—Sughrue, Mion, Zinn, Macpeak & Seas

[57] ABSTRACT

A silver halide color photographic material comprising a support having provided thereon at least one silver halide emulsion layer, which is characterized by containing a compound represented by the following formula (I):

$$A—L_1—L_2—INH—Q \quad (I)$$

wherein A represents a coupler residue; $L_1$ represents wherein W represents an oxygen atom, a sulfur atom, or —N($R_{13}$)—, $R_{11}$ and $R_{12}$ independently represent a hydrogen atom or a substituent, and $R_{13}$ represents a substituent, or $R_{11}$, $R_{12}$ and $R_{13}$ may each represent a divalent group and be connected together to form a cyclic structure; $L_2$ represents a group capable of releasing INH-Q through electron transfer along a conjugated system or has the same meaning as $L_1$; INH represents a development inhibitor residue connected to $L_2$ at the hetero atom thereof; and Q represents a secondary or tertiary alkyl group having from 3 to 5 carbon atoms, provided that when Q has a substituent(s), the total carbon atom number may exceed 5. Said silver halide color photographic material has high sensitivity and provides a color image with improved sharpness and improved graininess, and is freed from fluctuations of photographic properties during aging from photographing (exposure) up to development.

9 Claims, No Drawings

SILVER HALIDE COLOR PHOTOGRAPHIC MATERIAL

DETAILED EXPLANATION OF THE INVENTION

1. Field of Industrial Utility

This invention relates to a silver halide color photographic material containing a novel compound capable of releasing a development inhibitor having excellent development inhibitory activity with good timing during development processing.

2. Prior Art

In recent years, there has been a demand for a silver halide light-sensitive material particularly for photographing which has high sensitivity, such as ISO 400 sensitivity (Super HG-400), while exhibiting excellent image quality, including graininess and sharpness, equal to that of light-sensitive materials having ISO sensitivity 100 and also having excellent preservability.

Compounds which improve sharpness without deteriorating preservability of light-sensitive materials include those capable of imagewise releasing a development inhibitor via two or more timing groups as described in JP-A-60-218645, JP-A-60-249148, JP-A-61-156127, and U.S. Pat. No. 4,861,701. However, these compounds have an improper rate (timing) of releasing a development inhibitor or the development inhibitor released has inadequate diffusibility so that the improvements achieved on sharpness and graininess have been insufficient. Further, many of the light-sensitive materials containing these compounds undergo considerable increase in fog or marked reduction in sensitivity when preserved for a long time after exposure up to development processing or when exposed in a high-temperature and high-humidity condition.

European Patent 354,532A lately disclosed couplers capable of releasing a development inhibitor via a timing group whose development inhibitor moiety has a specifically designed structure so as to produce an enhanced interimage effect and also to improve sharpness. These couplers surely improve sharpness to some extent but not to a sufficient extent because the rate of releasing a development inhibitor cannot be easily controlled. In addition, they are still disadvantageous in that fluctuations of photographic performance are great depending on the time from exposure to development and temperature and humidity conditions.

OBJECT OF THE INVENTION

An object of the present invention is to propose a silver halide color photographic material which is excellent in sharpness and graininess and is less in fluctuations of photographic properties during aging after photographing (exposure) up to development.

MEANS FOR ACHIEVING THE OBJECT

The object of the present invention is accomplished by a silver halide color photographic material comprising a support having provided thereon at least one silver halide emulsion layer, which is characterized by containing a compound represented by formula (I):

$$A-L_1-L_2-INH-Q \qquad (I)$$

wherein A represents a coupler residue; $L_1$ represents

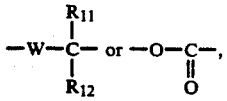

wherein W represents an oxygen atom, a sulfur atom, or $-N(R_{13})-$, $R_{11}$ and $R_{12}$ independently represent a hydrogen atom or a substituent, and $R_{13}$ represents a substituent, or $R_{11}$, $R_{12}$ and $R_{13}$ may each represent a divalent group and be connected together to form a cyclic structure; $L_2$ represents a group capable of releasing INH-Q through electron transfer along a conjugated system or has the same meaning as $L_1$; INH represents a development inhibitor residue connected to $L_2$ at the hetero atom thereof; and Q represents a secondary or tertiary alkyl group having from 3 to 5 carbon atoms, provided that when Q has a substituent(s), the total carbon atom number may exceed 5.

The compounds represented by formula (I) will be explained below.

In formula (I), A particularly represents a coupler residue.

The coupler residue represented by A includes, for example, yellow coupler residues (e.g., residues of open-chain keto-methylene couplers, e.g., acylacetanilide, malondianilide), magenta coupler residues (e.g., residues of 5-pyrazolone, pyrazolotriazole or imidazopyrazole couplers), cyan coupler residues (e.g., residues of phenol couplers, naphthol couplers, imidazole couples described in European Patent 249,453A, and pyrazolopyrimidine couplers described in European Patent 304,001A), and colorless coupler residues (e.g., residues of indanone or acetophenone couplers). Heterocyclic coupler residues as described in U.S. Pat. Nos. 4,315,070, 4,183,752, 4,174,969, 3,961,959, and 4,171,223 and JP-A-52-82423 are also usable.

Preferred examples of A are those represented by the following formula (Cp-1), (Cp-2), (Cp-3), (Cp-4), (Cp-5), (Cp-6), (Cp-7), (Cp-8), (Cp-9), (Cp-10) or (Cp-11). These couplers are preferred because of their high rate of coupling.

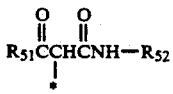

(Cp-1)

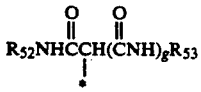

(Cp-2)

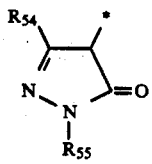

(Cp-3)

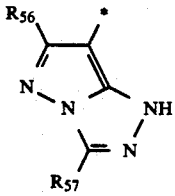

(Cp-4)

-continued (Cp-5)

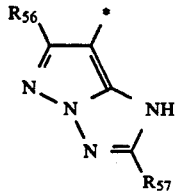

(Cp-6)

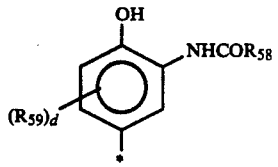

(Cp-7)

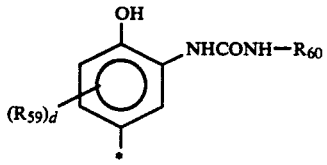

(Cp-8)

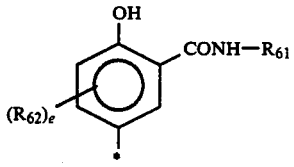

(Cp-9)

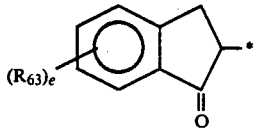

(Cp-10)

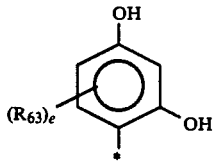

(Cp-11)

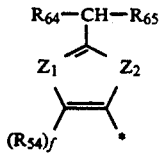

In the above formulae, the asterisk (*) on an extension from the coupling position means a position for bonding to the $L_1$ side moiety of formula (I).

In the above formulae, $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, $R_{63}$, $R_{64}$, or $R_{65}$ preferably contains a nondiffusible group. This being the case, the nondiffusible group is selected so as to give a total carbon atom number of from 8 to 40, and preferably from 10 to 30. In other cases, the total carbon atom number is preferably not more than 15.

In what follows, $R_{51}$ to $R_{65}$, $Z_1$, $Z_2$, g, d, e and f are explained in detail, wherein $R_{41}$ represents an aliphatic group, an aromatic group, or a heterocyclic group; $R_{42}$ represents an aromatic group or a heterocyclic group; and $R_{43}$, $R_{44}$, and $R_{45}$ each represent a hydrogen atom, an aliphatic group, an aromatic group, or a heterocyclic group.

$R_{51}$ has the same meaning as $R_{41}$. $R_{52}$ and $R_{53}$ each have the same meaning as $R_{42}$. g represents 0 or 1. $R_{54}$ has the same meaning as $R_{41}$ or represents $R_{41}CON(R_{43})$—, $R_{41}R_{43}N$—, $R_{41}SO_2N(R_{43})$—, $R_{41}S$—, $R_{43}O$—, $R_{41}N(R_{43})CON(R_{44})$—, or N≡C—. $R_{55}$ has the same meaning as $R_{41}$. $R_{56}$ and $R_{57}$ each have the same meaning as $R_{43}$ or represent $R_{41}S$—, $R_{43}O$—, $R_{41}CON(R_{43})$—, or $R_{41}SO_2N(R_{43})$—. $R_{58}$ s has the same meaning as $R_{41}$. $R_{59}$ has the same meaning as $R_{41}$ or represents $R_{41}CON(R_{43})$—, $R_{41}OCON(R_{43})$—, $R_{41}SO_2N(R_{43})$—, $R_{43}N(R_{44})CON(R_{45})$—, $R_{41}O$—, $R_{41}S$—, a halogen atom, or $(R_{41})N(R_{43})$—. d represents from 0 to 3. With d being a plural number, the plural groups $R_{59}$ may be the same or different, or each of them may represent a divalent group and be connected together to form a cyclic structure. Examples of such a cyclic structure include a pyridine ring and a pyrrole ring. $R_{60}$ has the same meaning as $R_{41}$. $R_{61}$ has the same meaning as $R_{41}$. $R_{62}$ has the same meaning as $R_{41}$ or represents $R_{41}OCONH$—, $R_{41}SO_2NH$—, $R_{43}N(R_{44})CON(R_{45})$—, $R_{43}N(R_{44})SO_2N(R_{45})$—, $R_{43}O$—, $R_{41}S$—, a halogen atom, or $R_{41}N(R_{43})$—. $R_{63}$ has the same meaning as $R_{41}$ or represents $R_{43}CON(R_{45})$—, $R_{43}N(R_{44})CO$—, $R_{41}SO_2N(R_{44})$—, $R_{43}SO_2$—, $R_{43}OCO$—, $R_{43}O$—$SO_2$—, a halogen atom, a nitro group, a cyano group, or $R_{43}CO$—. e represents an integer of from 0 to 4. Where there are plural $R_{62}$ or $R_{63}$ groups, they may be the same or different. $R_{64}$ and $R_{65}$ each represent $R_{43}N(R_{44})CO$—, $R_{41}CO$—, $R_{43}l$ $N(R_{44})SO_2$—, $R_{41}OCO$—, $R_{41}SO_2$—, a nitro group, or a cyano group. Z represents a nitrogen atom or

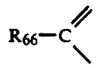

(wherein $R_{66}$ represents a hydrogen atom or has the same meaning as $R_{63}$). $Z_2$ represents a sulfur atom or an oxygen atom. f represents 0 or 1.

The "aliphatic group" as used above is a saturated or unsaturated, acyclic or cyclic, straight chain or branched, and substituted or unsubstituted aliphatic hydrocarbon group having from 1 to 32, and preferably from 1 to 22, carbon atoms. Typical examples are methyl, ethyl, propyl, isopropyl, butyl, t-butyl, i-butyl, t-amino, hexyl, cyclohexyl, 2-ethylhexyl, octyl, 1,1,3,3-tetramethylbutyl, decyl, dodecyl, hexadecyl and octadecyl.

The "aromatic group" as used above is an aromatic group having from 6 to 20 carbon atoms, and preferably a substituted or unsubstituted phenyl group or a substituted or unsubstituted naphthyl group.

The "heterocyclic group" as used above is a substituted or unsubstituted heterocyclic group having from 1 to 20, and preferably from 1 to 7, carbon atoms, containing a hetero atom selected from a nitrogen atom, an oxygen atom, and a sulfur atom, and preferably consisting of 3 to 8 members. Typical examples of such a heterocyclic group are 2-pyridyl, 2-furyl, 2-imidazolyl, 1-indolyl, 2,4-dioxo-1,3-imidazolidin-5-yl, 2-benzoxazolyl, 1,2,4-triazol-3-yl, and 4-pyrazolyl.

Where these aliphatic hydrocarbon groups, aromatic groups, and heterocyclic groups have a substituent, typical substituents include a halogen atom, $R_{47}O$—, $R_{47}S$—, $R_{47}CON(R_{48})$—, $R_{47}N(R_{48})CO$—, $R_{46}O$-$CON(R_{47})$—, $R_{47}SO_2N(R_{47})$—, $R_{47}N(R_{48})SO_2$—, $R_{46}SO_2$—, $R_{47}OCO$—, $R_{47}N(R_{48})CON(R_{49})$—, a group having the same meaning as $R_{46}$, $R_{46}COO$—, $R_{47}OSO_2$—, a cyano group, and a nitro group; wherein $R_{46}$ represents an aliphatic group, an aromatic group, or a heterocyclic group; and $R_{47}$, $R_{48}$, and $R_{49}$ each represent an aliphatic group, an aromatic group, a heterocyclic group, or a hydrogen atom. The terminologies "aliphatic group", "aromatic group" and "heterocyclic group" as used here have the same meanings as defined above.

Preferred ranges of $R_{51}$ to $R_{65}$, g, d, and f will be explained below.

$R_{51}$ preferably represents an aliphatic group or an aromatic group. $R_{52}$ and $R_{55}$ preferably represent an aromatic group. $R_{53}$ preferably represents an aromatic group or a heterocyclic group.

In formula (Cp-3), $R_{54}$ preferably represents $R_{41}CONH$— or $R_{41}$—$N(R_{43})$—. $R_{56}$ and $R_{57}$ preferably represent an aliphatic group, an aromatic group, $R_{41}O$—, or $R_{41}S$—. $R_{58}$ preferably represents an aliphatic group or an aromatic group; In formula (Cp-6), $R_{59}$ preferably represents a chlorine atom, an aliphatic group, or $R_{41}CONH$—; d preferably represents 1 or 2; and $R_{60}$ preferably represents an aromatic group. In formula (Cp-7), $R_{59}$ preferably represents $R_{41}CONH$—; d preferably represents 1; and $R_{61}$ preferably represents an aliphatic group or an aromatic group. In formula (Cp-8), d preferably represents 0 or 1; and $R_{62}$ preferably represents $R_{41}OCONH$—, $R_{41}CONH$—, or $R_{41}SO_2NH$—, each of which is preferably substituted at the 5-position of the naphthol ring. In formula (Cp-9), $R_{63}$ preferably represents $R_{41}CONH$—, $R_{41}SO_2NH$—, $R_{41}N(R_{41})SO_2$—, $R_{41}SO_2$—, $R_{41}N(R_{43})CO$—, a nitro group, or a cyano group; and e preferably represents 1 or 2. In formula (Cp-10), $R_{63}$ preferably represents $R_{43}N(R_{44})CO$—, $R_{43}OCO$—, or $R_{43}CO$—; and e preferably represents 1 or 2. In formula (Cp-11), $R_{54}$ preferably represents an aliphatic group, an aromatic group, or $R_{41}CONH$—; and f preferably represents 1.

In formula (I), the group as represented by $L_1$ is a group represented by the formula shown below or a group represented by the following formula (T-1), wherein * indicates a position for bonding to A of the compound represented by formula (I), and ** indicates a position for bonding to $L_2$.

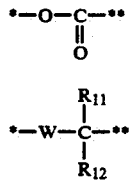

(T-1)

In formula (T-1), W represents an oxygen atom, a sulfur atom, or —$N(R_{13})$—; $R_{11}$ and $R_{13}$ each represent a hydrogen atom or a substituent; and $R_{13}$ represents a substituent.

Typical examples of the substituent represented by $R_{11}$ and $R_{12}$ and of the substituent represented by $R_{13}$ include $R_{15}$, $R_{15}CO$—, $R_{15}SO_2$—, $R_{15}N(R_{16}CO$—, and $R_{15}N(R_{16})SO_2$—, wherein $R_{15}$ represents an aliphatic group, an aromatic group, or a heterocyclic group, and $R_{16}$ represents a hydrogen atom, an aliphatic group, an aromatic group, or a heterocyclic group. Each of $R_{11}$, $R_{12}$, and $R_{13}$ may represent a divalent group and be connected together to form a cyclic structure.

The group represented by formula (T-1) includes those represented by the following formulae:

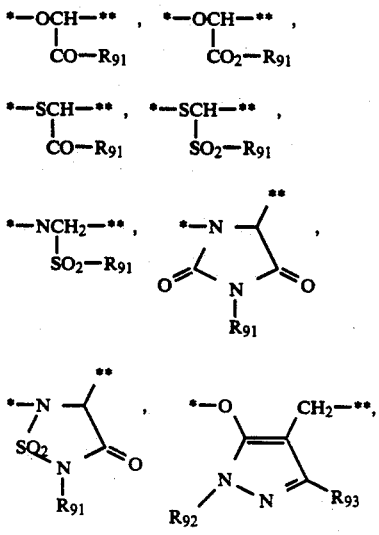

$R_{91}$ represents an alkyl group (e.g., methyl, ethyl, isopropyl, t-butyl, t-amyl, sec-butyl, isobutyl) or an aryl group (e.g., phenyl, p-nitrophenyl, p-hydroxyphenyl, p-methoixyphenyl, o-methoxyphenyl).

Specific examples of the group represented by formula (T-1) are shown below.

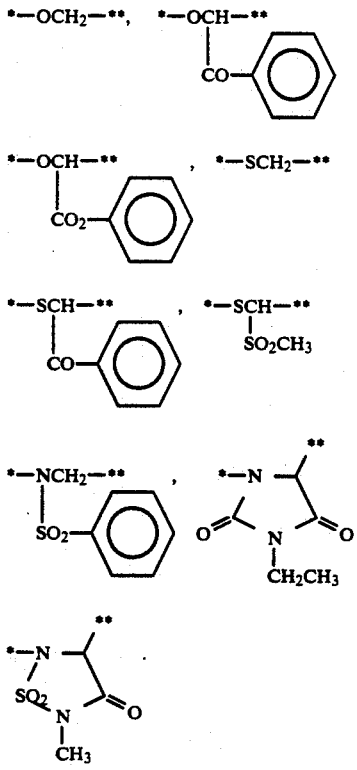

Of these groups, more preferred are those in which either one or both of $R_{11}$ and $R_{12}$ represent(s) a hydrogen atom.

In formula (I), when $L_2$ represents a group which induces a cleavage reaction by making use of an electron transfer reaction along a conjugated system, such a group is a group represented by formula (T-2) shown below which is described, e.g., in U.S. Pat. Nos. 4,409,323, 4,421,845, JP-A-57-188035, JP-A-58-98728, JP-A-58-209736, JP-A-58-209737, and JP-A-58-209738.

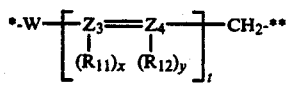

(T-2)

wherein W, $R_{11}$, and $R_{12}$ have the same meanings as in formula (T-1); * and ** represent a position for bonding to $L_1$ and INH-Q of formula (I), respectively; or $R_{11}$ and $R_{12}$ may be taken together to form a benzene ring or a heterocyclic ring, or $R_{11}$ or $R_{12}$ may be taken together with W to form a heterocyclic ring.

$Z_3$ and $Z_4$ independently represent a carbon atom or a nitrogen atom; and x and y represent 0 or 1. When $Z_3$ is a carbon atom, x is 1. When $Z_3$ is a nitrogen atom, x is 0. The relationship between $Z_3$ and x also applies to that between $Z_4$ and y. t represents 1 or 2. When t is 2, the two moieties:

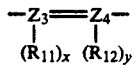

may be the same or different.

The group represented by formula (T-2) preferably includes those represented by the following formulae:

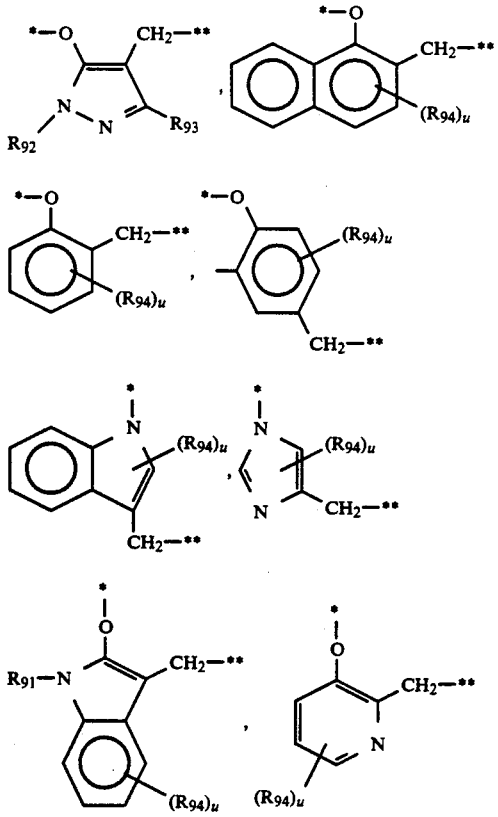

-continued

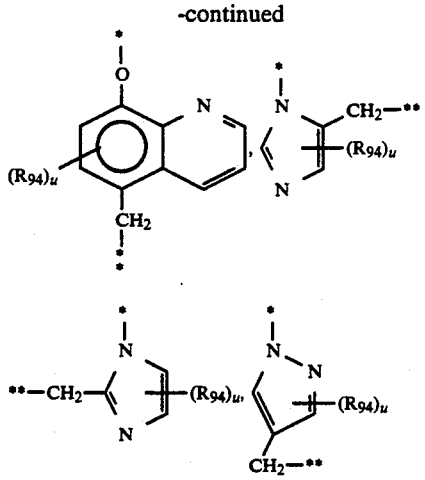

$R_{91}$ represents an alkyl group (e.g., methyl, ethyl, isopropyl, t-butyl, t-amyl, sec-butyl, isobutyl) or an aryl group (e.g., phenyl, p-nitrophenyl, p-hydroxyphenyl, p-methoxyphenyl, o-methoxyphenyl). $R_{92}$ represents an alkyl group (specific examples are the same as above), an aryl group (specific examples are the same as above), an acyl group (e.g., acetyl, propanoyl, pivaloyl), a sulfonyl group (e.g., methane sulfonyl), or an alkoxycarbonyl group (e.g., methoxycarbonyl, ethoxycarbonyl). $R_{93}$ represents a hydrogen atom, an alkyl group, an aryl group, an alkoxycarbonyl group (specific examples of these groups are the same as for $R_{91}$ and $R_{92}$), a nitro group, a cyano group, a halogen atom (e.g., fluoro, chloro, bromo), an alkoxy group (e.g., methoxy, ethoxy), an aryloxy group(e.g., phenoxy, p-nitrophenoxy), a carbamoyl group (e.g., carbamoyl, dimethylcarbamoyl, methylcarbamoyl, propylcarbamoyl), a sulfamoyl group (e.g., sulfamoyl, methylsulfamoyl), anacylamino group (e.g., methansulfonylamino), an amino group (e.g., dimethylamino, diethylamino, phenylamino), an alkylthio group (e.g., methylthio, ethylthio, isopropylthio), or an arylthio group (e.g., phenylthio). $R_{94}$ represents any of the groups represented by $R_{93}$ except for a hydrogen atom, and u represents 0, 1, or 2, provided that with u being 2, two $R_{94}$ group may be the same or different.

Specific examples of the group represented by formula (T-2) are shown below.

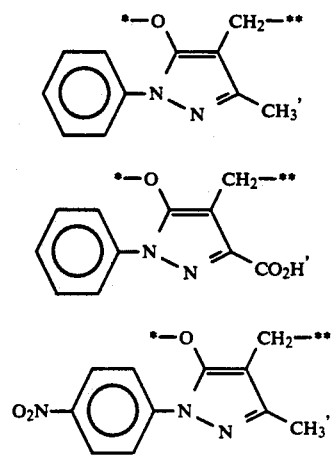

-continued

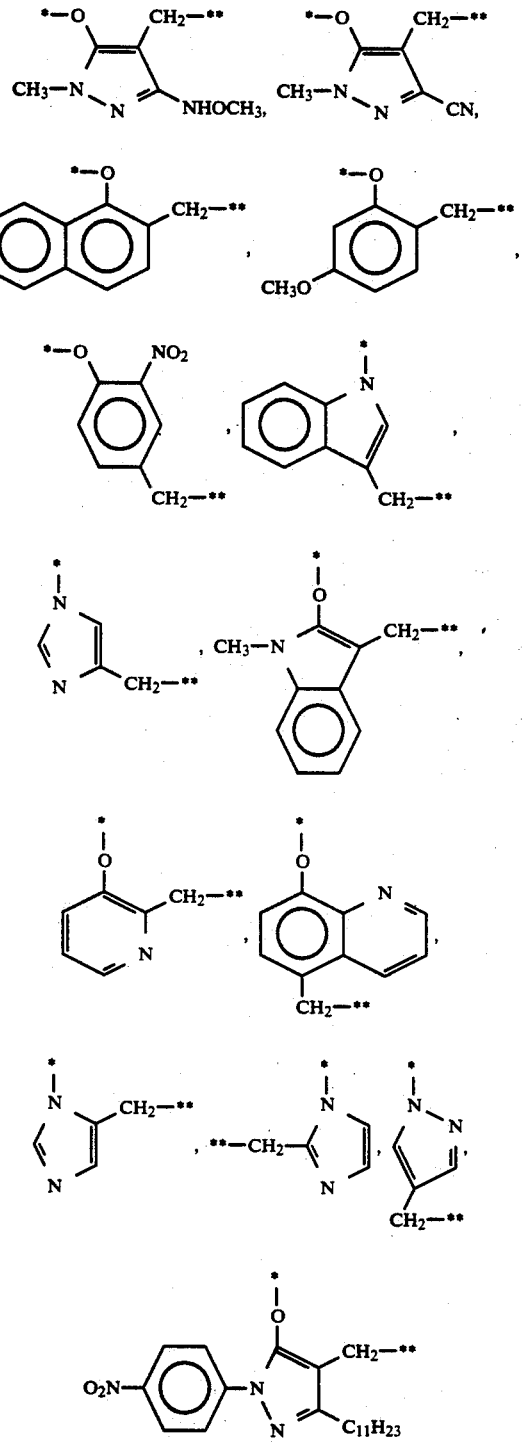

More preferred of these groups are those which are bonded to $L_1$ at the nitrogen atom thereof.

In the compounds represented by formula (I), the group represented by INH is a development inhibitor residue which is bonded to $L_2$ at the hetero atom thereof, and preferably a group represented by any of the following formulae (INH-1) through (INH-13):

(INH-1)

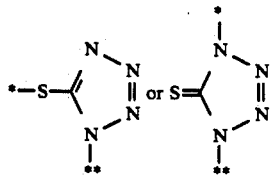

(INH-2)

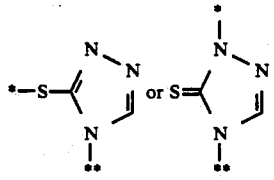

(INH-3)

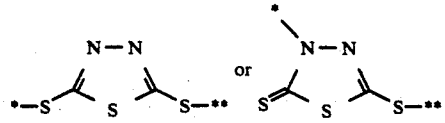

(INH-4)

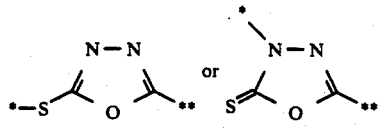

(INH-5)

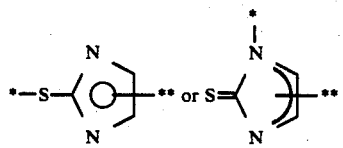

(INH-6)

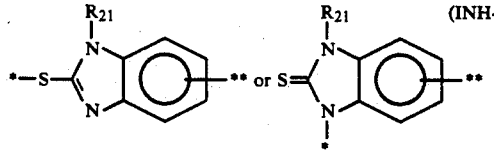

wherein $R_{21}$ represents a hydrogen atom, a substituted or unsubstituted hydrocarbon group (e.g., methyl, ethyl, propyl, phenyl).

(INH-7)

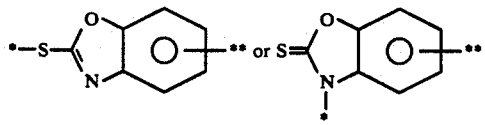

(INH-8)

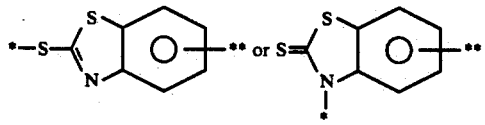

(INH-9)

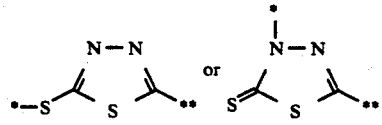

(INH-10)

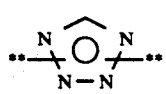

-continued (INH-11)

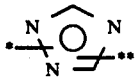

(INH-12)

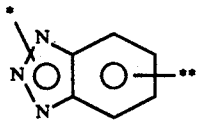

(INH-13)

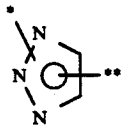

wherein * and ** indicate a position for bonding to $L_2$ or Q in the compound of formula (I), respectively.

More preferred of these groups are (INH-1), (INH-2), (INH-3), (INH-4), (INH-9), and (INH-12), with (INH-1) being particularly preferred.

In the compounds represented by formula (I), the group as represented by Q represents a secondary or tertiary alkyl group having from 3 to 5 carbon atoms. More specifically, Q represents an isopropyl group, a 2-butyl group, a t-butyl group, a 2-amyl group, a 3-amyl group, or a t-amyl group, each of which may have a substituent.

Examples of the substituent include an alkoxy group (e.g., methoxy, ethoxy, isopropyloxy), an alkylthio group (e.g., methylthio, ethylthio, 2-methylthioethylthio), a halogen atom (e.g., fluoro, chloro), a hydroxyl group, a cyano group, a nitro group, and a carbamoyl group, with an alkoxy group or an aklylthio group being preferred. The formular weight of the group represented by Q is preferably less than 100, and more preferably less than 80. Q is preferably an unsubstituted group, more preferably a tertiary alkyl group, and most preferably a t-butyl group.

Specific examples of the compounds represented by formula (I) are shown below, but the present invention is not limited thereto.

ILLUSTRATIVE COMPOUNDS

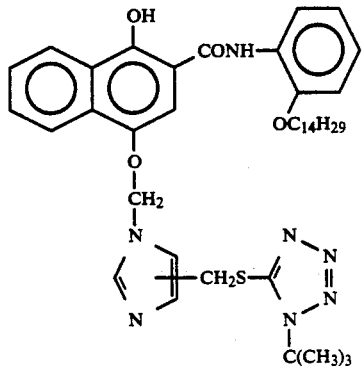

In the moiety

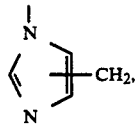

$—CH_2—$ is bonded at the 4- or or 5-position of the imidazole ring (hereinafter the same).

(2)

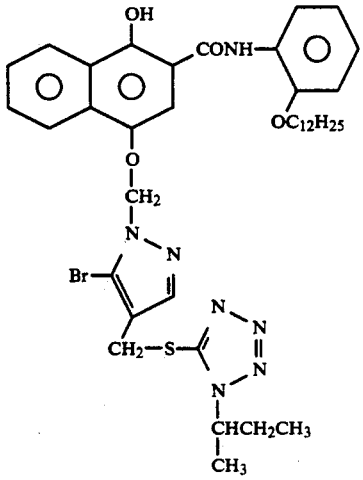

-continued
(3)
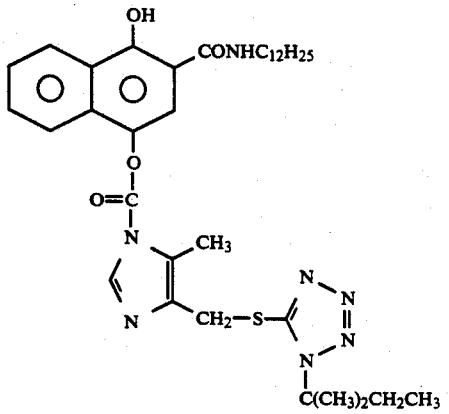
(4)
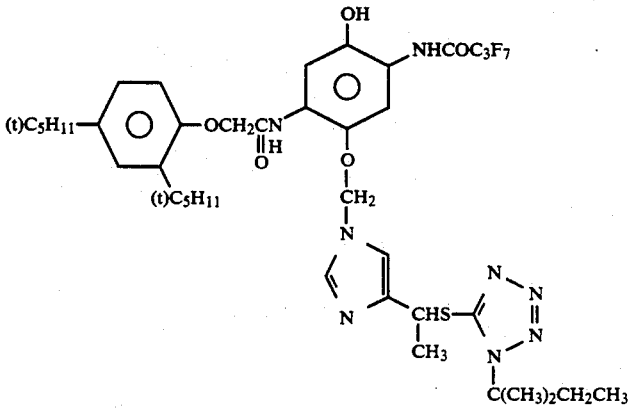
(5)
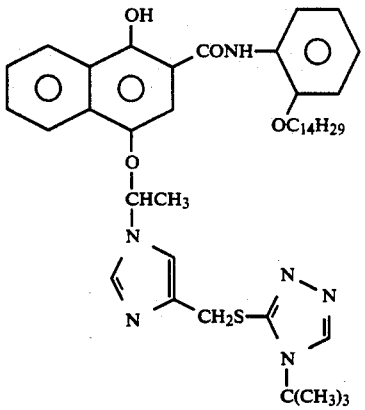
(6)
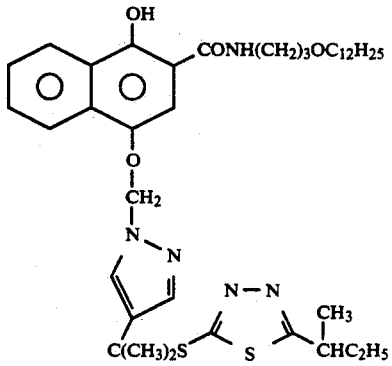

-continued
(7)
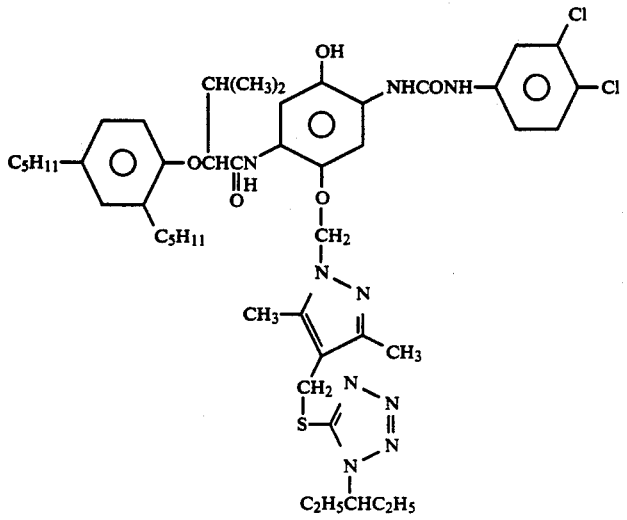
(8)
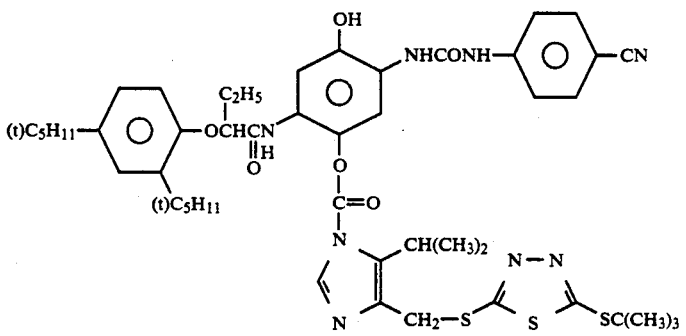
(9)
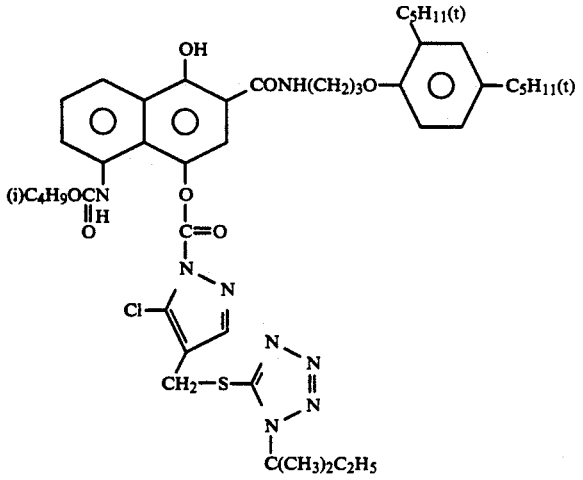

-continued
(10)
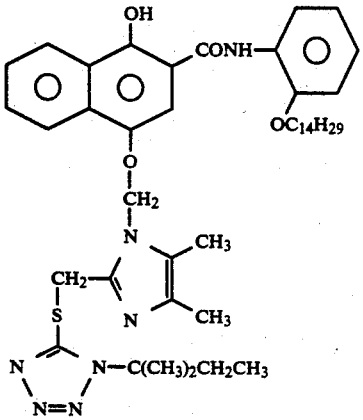
(11)
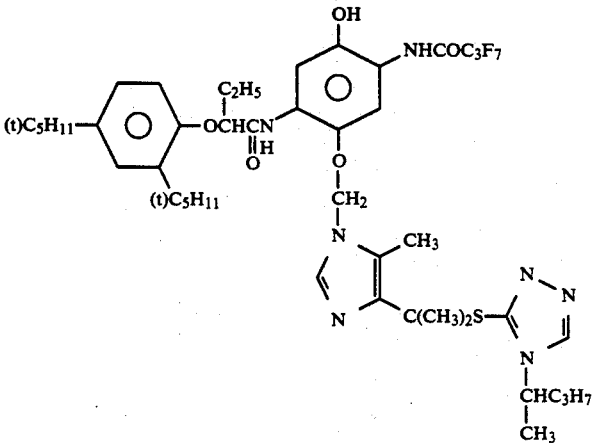
(12)
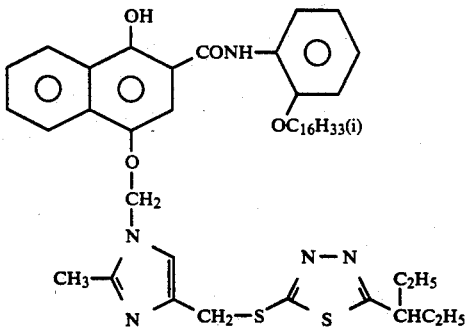
(13)
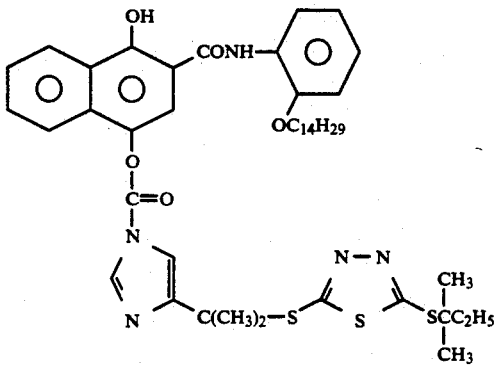

-continued
(14)
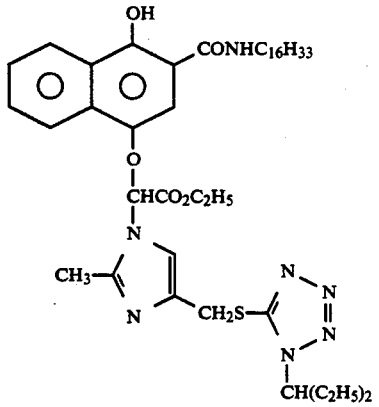
(15)
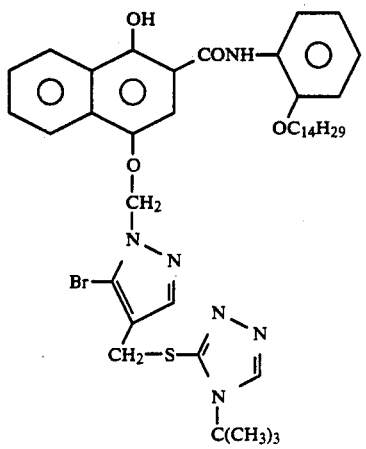
(16)
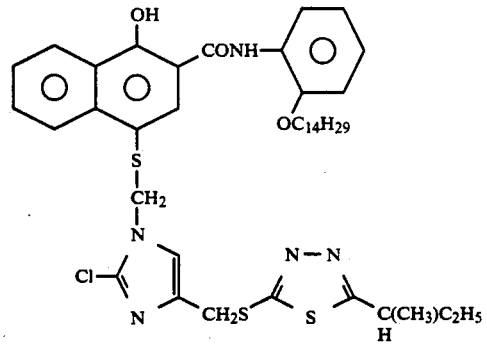
(17)
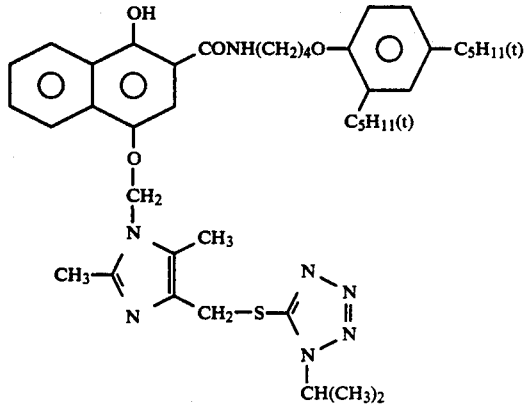

-continued
(18)
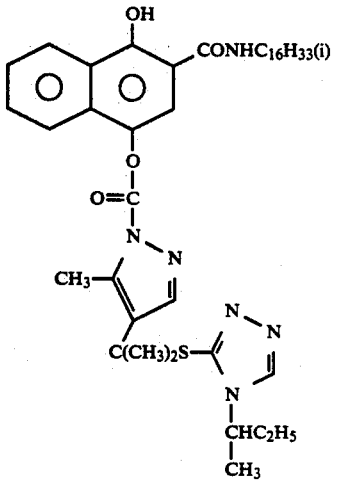
(19)
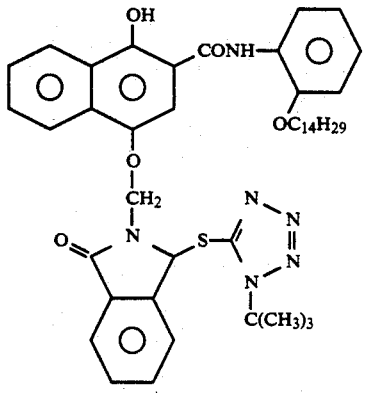
(20)
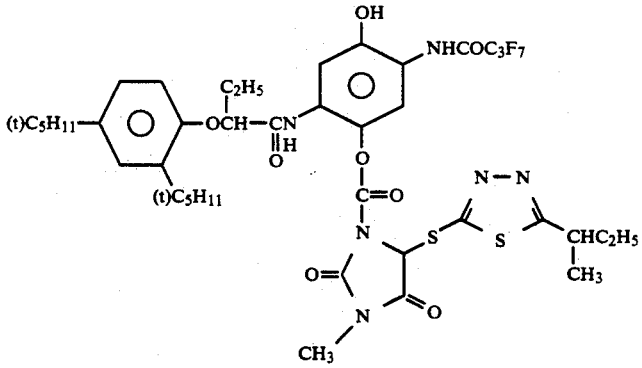
(21)
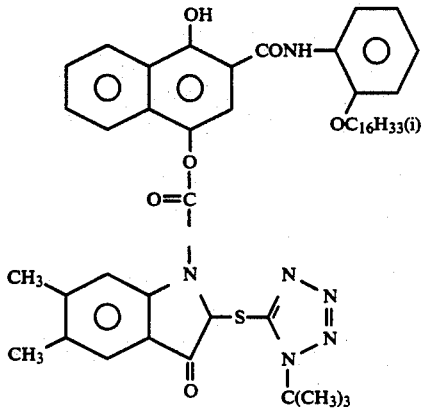

-continued
(22)
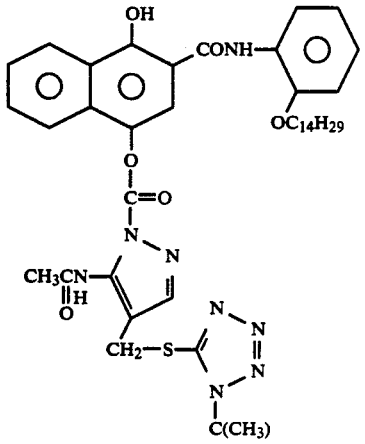
(23)
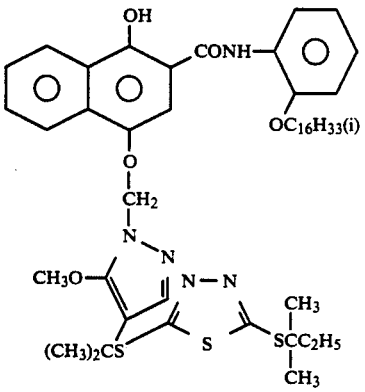
(24)
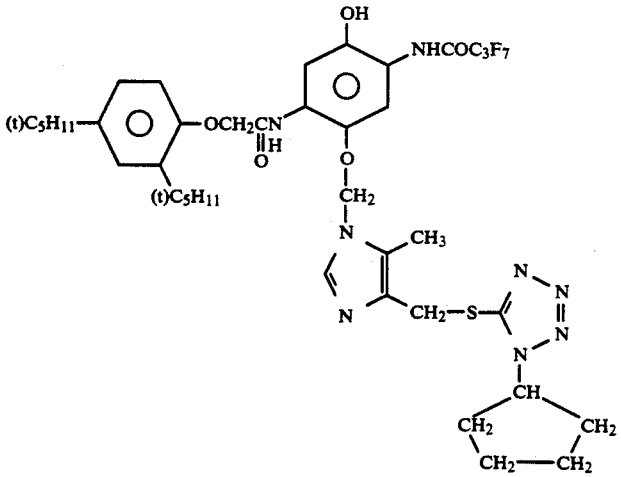

-continued
(25)
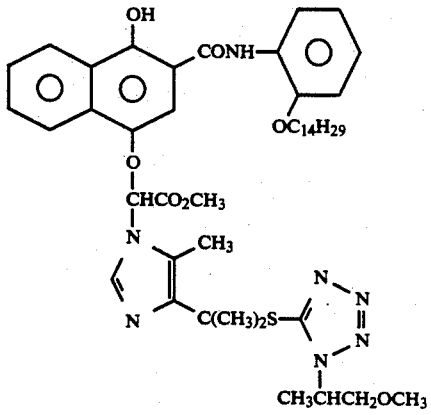
(26)
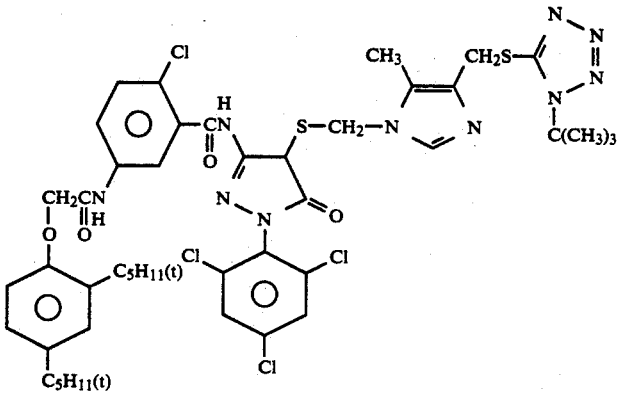
(27)
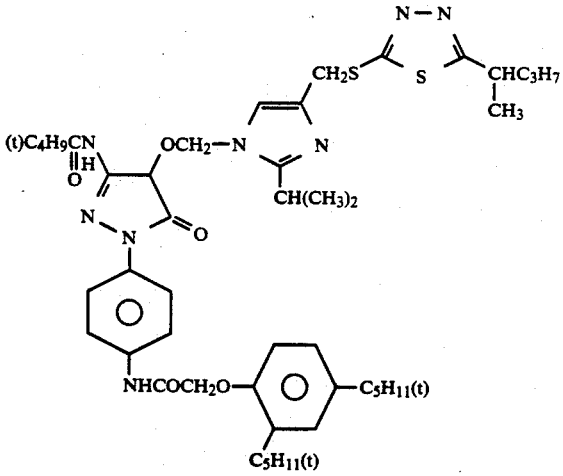
(28)
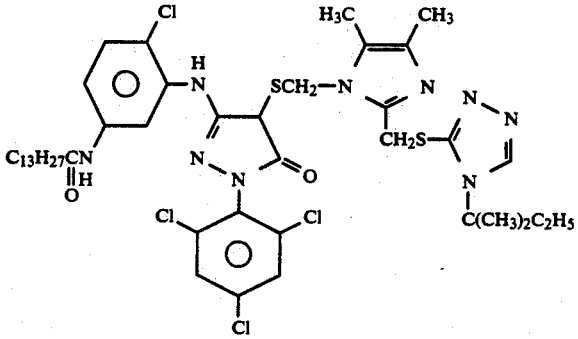

-continued
(29)
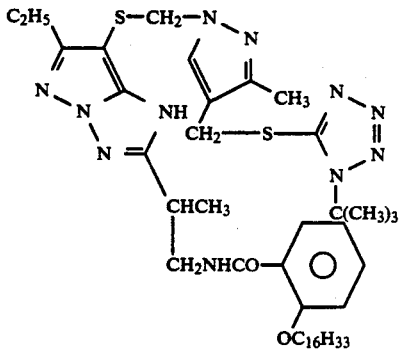
(30)
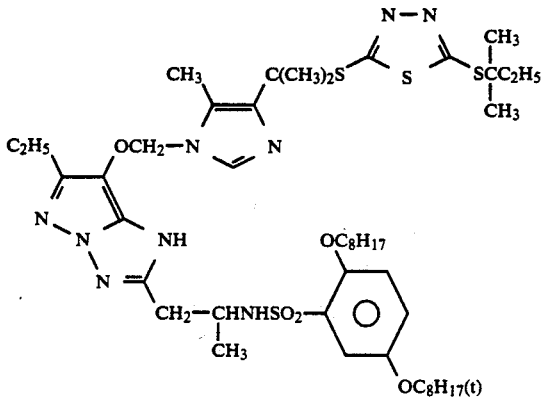
(31)
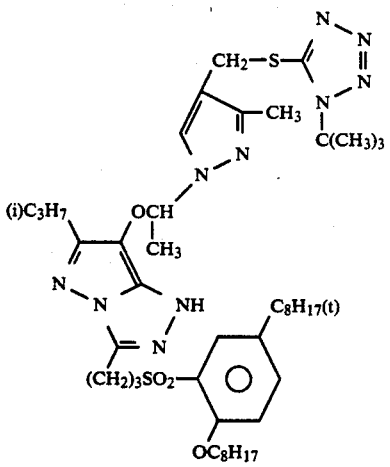
(32)
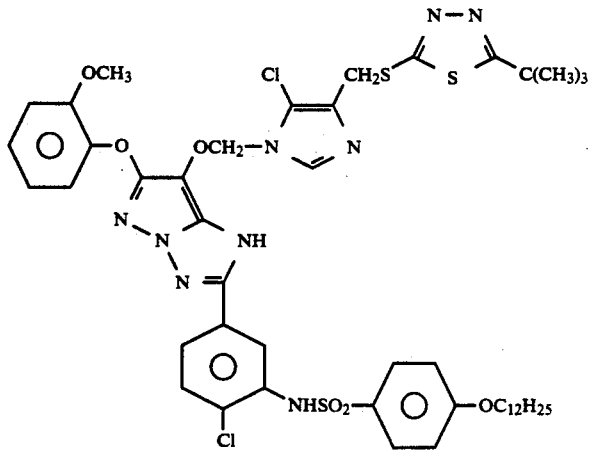

-continued
(33)
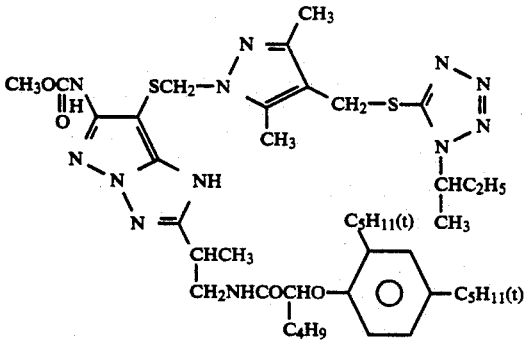
(34)
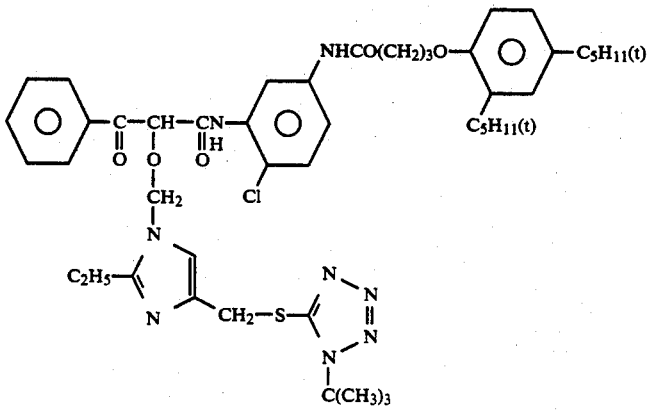
(35)
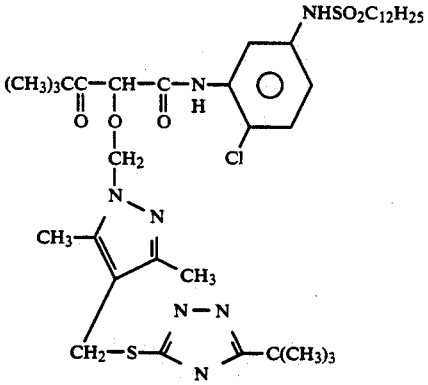
(36)
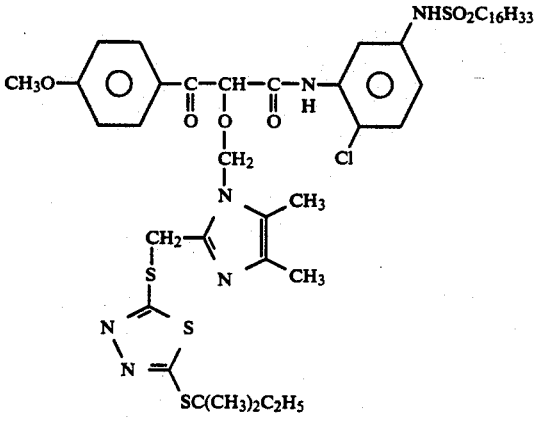

-continued
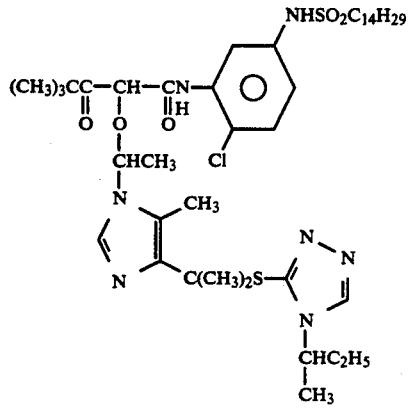
(37)
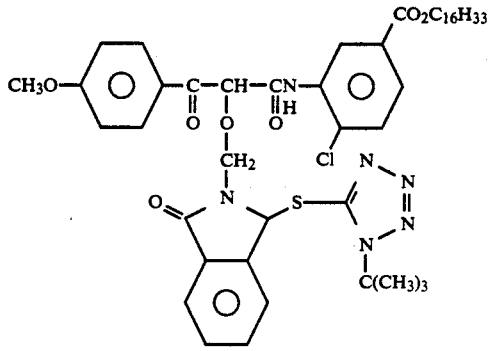
(38)
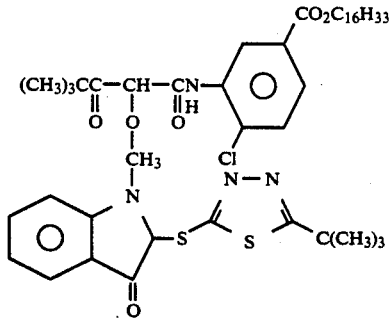
(39)
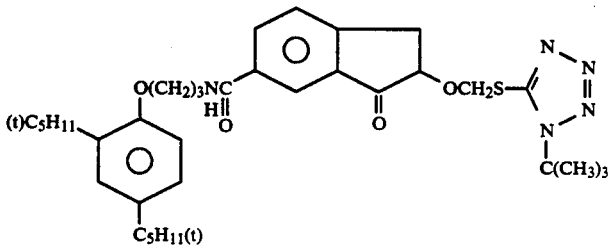
(40)

-continued
(41)
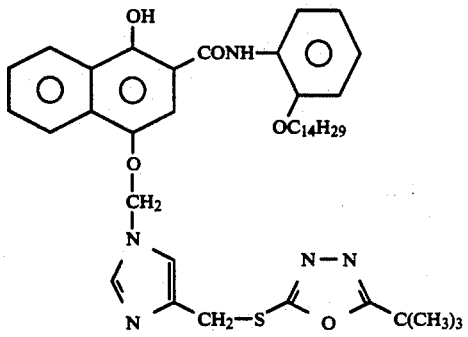
(42)
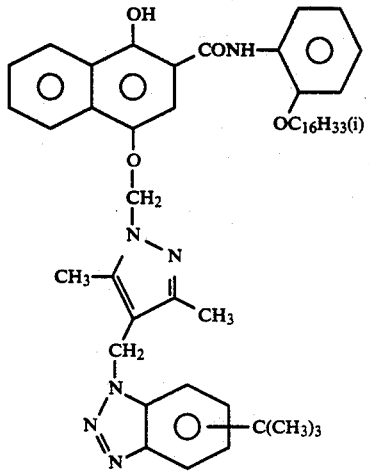
(43)
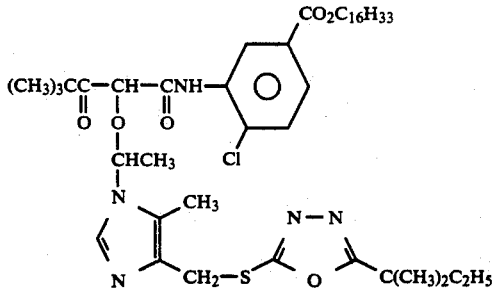
(44)
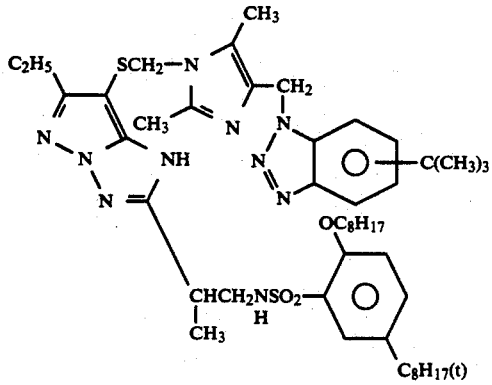

-continued
(45)
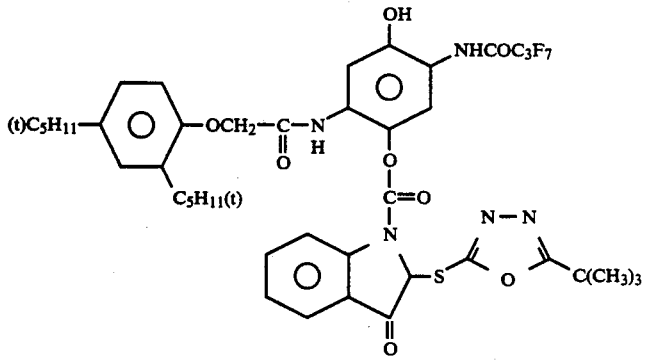
(46)
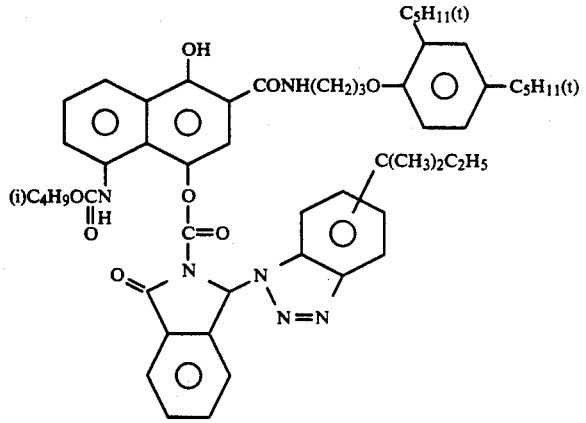
(47)
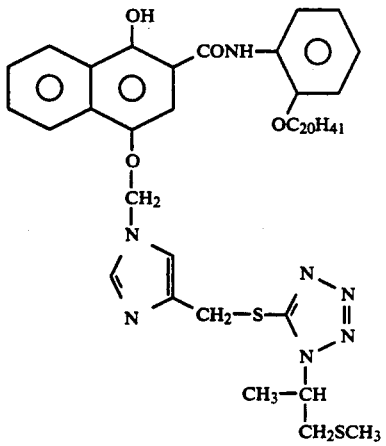

-continued
(48)
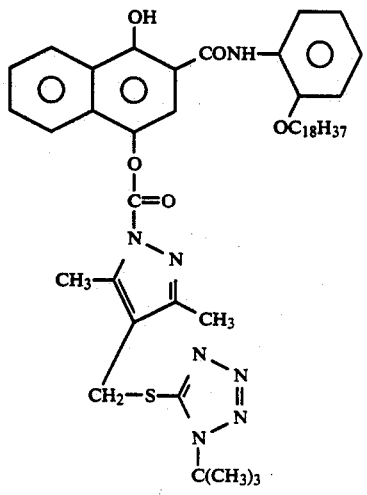
(49)
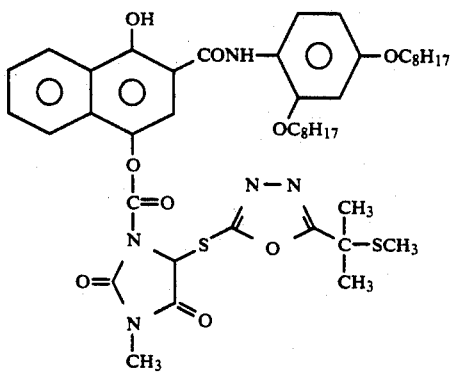
(50)
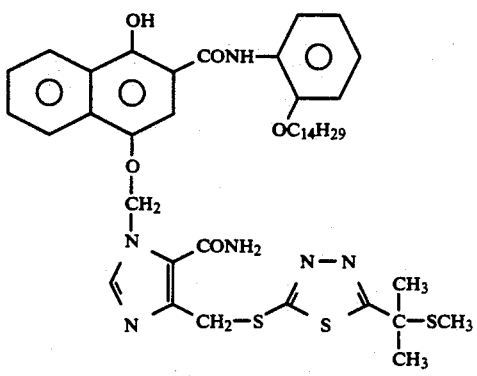

-continued
(51)
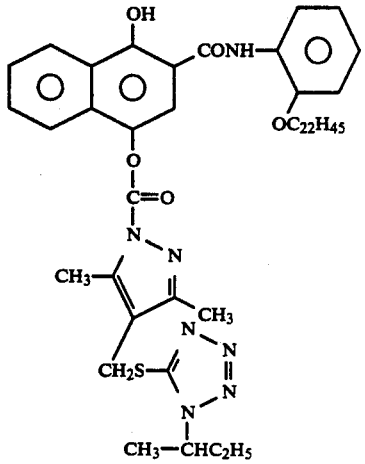
(52)
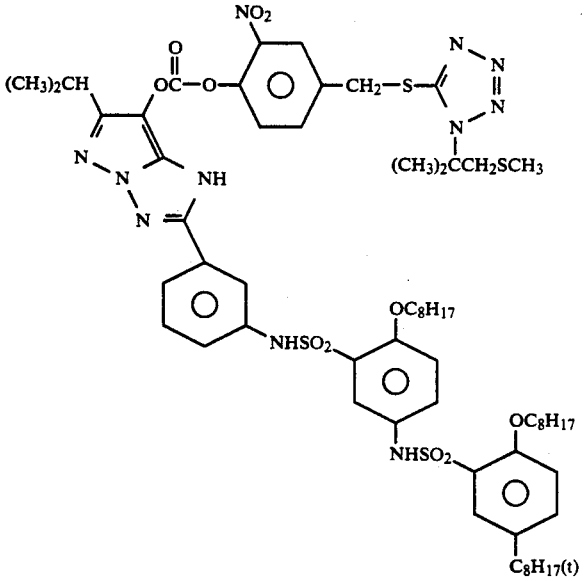
(53)
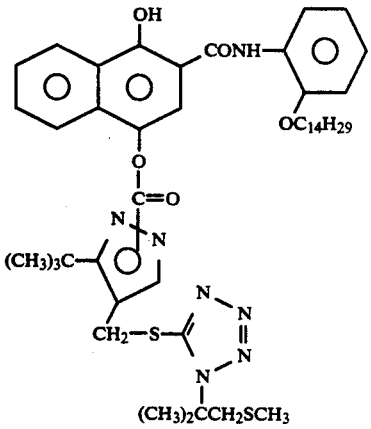

-continued
(54)
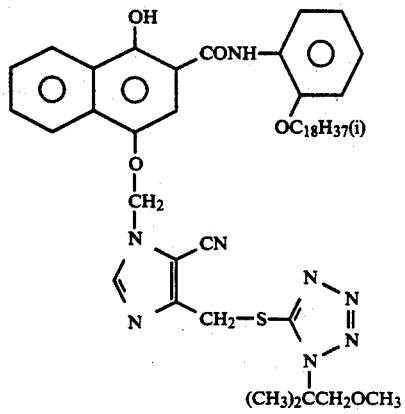
(55)
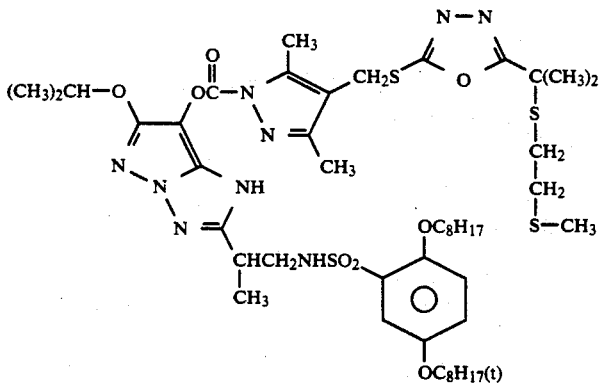
(56)
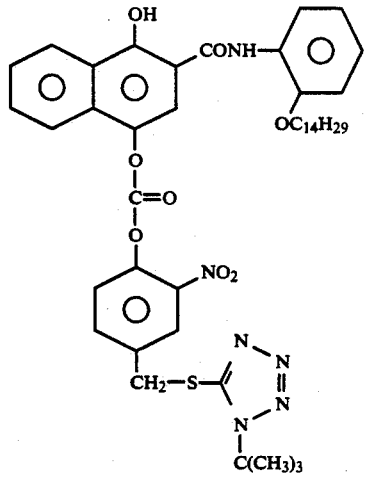

-continued
(57)
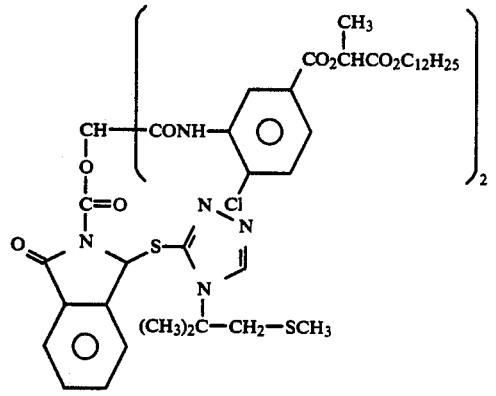
(58)
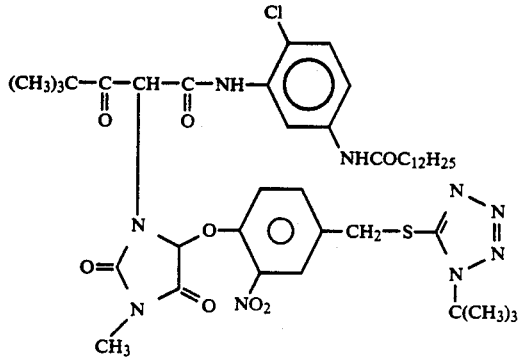
(59)
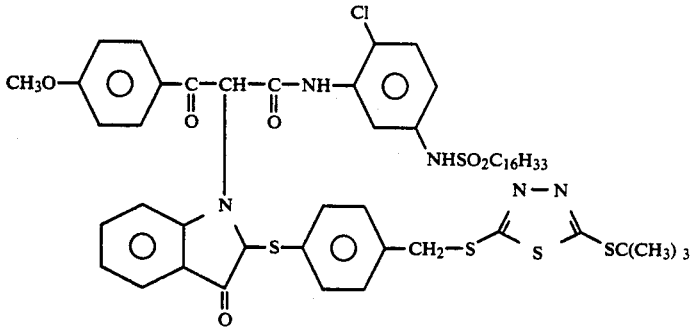
(60)
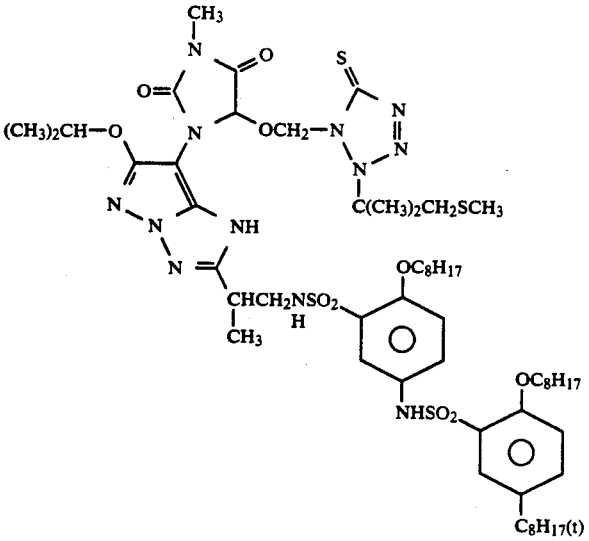
The compounds of the present invention can be synthesized according to the process described in JP-A-60-

SYNTHESIS EXAMPLE 1

Synthesis of Compound (1)

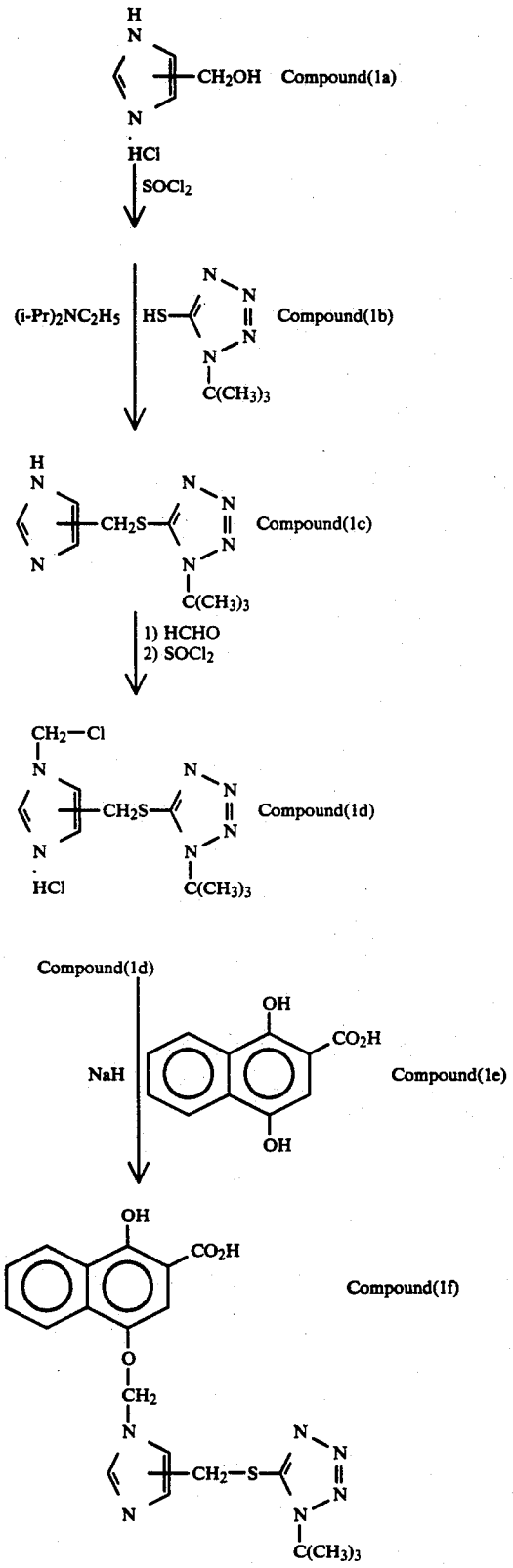

-continued

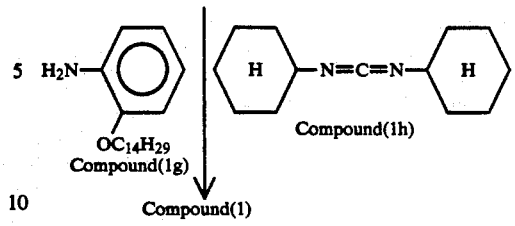

Step 1: Synthesis of Compound (1c)

Compound (1a) (4- or 5-hydroxymethylimidazole hydrochloride, 13.4 g) was refluxed in thionyl chloride (30 cc) for 1.5 hours. After removing thionyl chloride by distillation under reduced pressure, methylene chloride (40 cc) was added to the residue, and the solvent was removed by distillation under reduced pressure. The thus obtained crude crystal was added to a DMF solution (60 cc) of compound (1b) (15.8 g) and diisopropylethylamine (25.8 g), and the mixture was allowed to react for 2 hours. Water was added to the reaction mixture, and the precipitated crystal was collected by filtration to obtain 21 g of compound (1c).

Step 2: Synthesis of Compound (1d)

Compound (1c) (21 g) and a 37% formalin aqueous solution (22.5 cc) were reacted in acetic acid (80 cc) at 80° C. for 2 hours. The solvent was removed by distillation under reduced pressure, and thionyl chloride (30 cc) was added thereto, followed by allowing the mixture to react at reflux for 2 hours. The excess of thionyl chloride was removed under reduced pressure, and diethyl ether was added to the residue to obtain 28 g of a crude crystal of compound (1d).

Step 3: Synthesis of Compound (1f)

Three grams of sodium hydride (60% oil dispersion) was added to a DMF solution (30 cc) of compound (1e) (5.1 g), and compound (1d) (7.8 g) was added thereto to react for 3 hours. To the reaction mixture was added 1N hydrochloric acid to stop the reaction, and the reaction mixture was extracted with chloroform. The extract was washed with water, dried over sodium sulfate, and concentrated to obtain an oily substance, which was then purified by silica gel column chromatography using chloroform-MeOH (5:1) as an eluent to obtain 1.5 g of compound (1f).

Step 4: Synthesis of Compound (1)

To a suspension of compound (1f) (1.4 g) and compound (1 g) (0.9 g) in ethyl acetate (30 cc) were added a solution of compound (1h) (0.6 g) in ethyl acetate (6 cc) and N,N-dimethylaminopyridine (0.05 g), and the mixture was allowed to react overnight. The precipitated crystal was separated by filtration, and the filtrate was concentrated.

The resulting oily substance was purified by silica gel column chromatography (ethyl acetate-hexane = 1:2) to obtain compound (1) as a crude crystal. The structure of compound (1) was confirmed by $M^+ = 741$ in mass spectrum.

SYNTHESIS EXAMPLE 2

Synthesis of Compound (9)

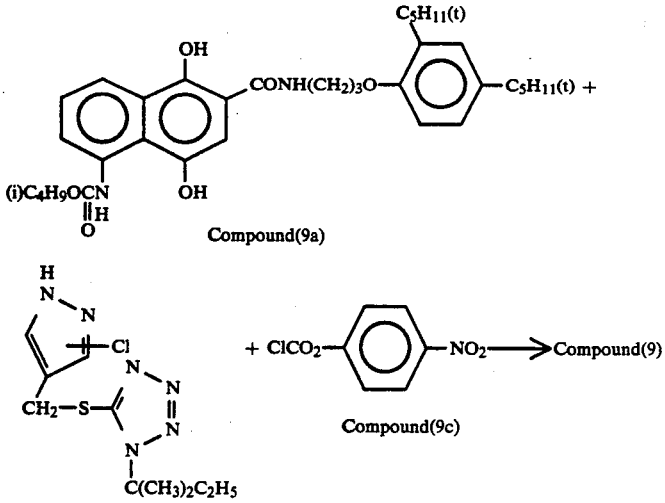

Compound (9b) (20 mmol) synthesized in the same manner as in Synthesis Example 1 and compound (9c) (20 mmol) were reacted in methylene chloride (30 cc) for 1 hour. To the reaction mixture was added a solution of compound (9a) (20 mmol) in ethyl acetate (80 cc), and diisopropylethylamine (60 mmol) was then added thereto, followed by allowing the mixture to react for 1 hour. To the reaction mixture was added 1N hydrochloric acid (50 cc) to stop the reaction. After the reaction mixture was diluted with chloroform (100 cc), the organic layer was washed with water. The organic layer was dried over sodium sulfate and concentrated, and the residue was purified by silica gel column chromatography (ethyl acetate-hexane=1:3) to obtain compound (9). The structure was confirmed by mass spectrum and elemental analysis.

While the compounds represented by formula (I) according to the present invention may be used in any layer of a light-sensitive material, they are preferably added to a light-sensitive silver halide emulsion layer and/or a layer adjacent thereto, more preferably a light-sensitive silver halide emulsion layer, and most preferably a red-sensitive silver halide emulsion layer. The total amount of the compounds added is usually from $3\times10^{-7}$ to $1\times10^{-3}$ mol/m$^2$, preferably from $3\times10^{-6}$ to $5\times10^{-7}$ mol/m$^2$, and more preferably from $1\times10^{-5}$ to $2\times10^{-4}$ mol/m$^2$.

The compounds represented by formula (I) according to the present invention can be incorporated into a light-sensitive material in the same manner as for ordinary couplers as hereinafter described.

The light-sensitive material according to the present invention comprises a support having provided thereon at least one of a blue-sensitive silver halide emulsion layer, a green-sensitive silver halide emulsion layer, and a red-sensitive silver halide emulsion layer. There is no particular limitation in number and order of silver halide emulsion layers. A typical example is a silver halide light-sensitive material comprising a support having thereon at least one set of light-sensitive layers comprising plural silver halide emulsion layers having substantially the same color sensitivity and differing in photosensitivity. Such a set of light-sensitive layers is a unit light-sensitive layer having color sensitivity to any of blue light, green light, and red light. In the case of multi-layer silver halide light-sensitive materials, unit light-sensitive layers are usually arranged in the order of a red-sensitive layer, a green-sensitive layer, and a blue-sensitive layer from the side of a support. Depending on the purpose, the order of these unit layers may be reversed, or layers having the same color sensitivity may have therebetween a light-sensitive layer of different color sensitivity.

The light-sensitive material may have various types of light-insensitive layers such as interlayers between silver halide light-sensitive layers or as an uppermost or lowermost layer.

The interlayers may contain couplers, DIR compounds, etc. as described in JP-A-61-43748, JP-A-59-113438, JP-A-59-113440, JP-A-61-20037, and JP-A-61-20038, and may also contain color mixing inhibitors as is usual.

Each unit light-sensitive layer preferably has a two-layer structure composed of a high sensitivity emulsion layer and a low sensitivity emulsion layer as described in West German Patent 1,121,470 or British Patent 923,045. Usually, these two layers are preferably arranged so that sensitivity descends toward the support. A light-insensitive layer may be provided between the silver halide emulsion layers. It is also possible to provide a low sensitivity emulsion layer in the side farther from the support and a high sensitivity emulsion layer in the side closer to the support as described in JP-A-57-112751, JP-A-62-200350, JP-A-62-206541, and JP-A-62-206543.

Specific examples of layer orders include an order of low sensitivity blue-sensitive layer (BL)/high sensitivity blue-sensitive layer (BH)/high sensitivity green-sensitive layer (GH)/low sensitivity green-sensitive layer (GL)/high sensitivity red-sensitive layer (RH)/low sensitivity red-sensitive layer (RL), an order of BH/BL/GL/GH/RH/RL, and an order of BH/BL/GH/GL/RL/RH each from the side farthest from the support.

The layers may be arranged in the order of blue-sensitive layer/GH/RH/GL/RL from the side farthest from the support as described in JP-B-55-34932. The layers may also be arranged in the order of blue-sensitive layer/GL/RL/GH/RH from the side farthest from the support as described in JP-A-56-25738 and JP-A-62-63936.

Further, a unit light-sensitive layer may be composed of three layers whose photosensitivity differs in a descending order toward the support, i.e., the highest sensitivity silver halide emulsion layer as an upper layer, a middle sensitivity silver halide emulsion layer as a middle layer, and the lowest sensitivity silver halide emulsion layer as a lower layer, as described in JP-B-49-15495. Three layers of different sensitivity in each unit layer may be arranged in the order of middle sensitivity emulsion layer/high sensitivity emulsion layer/low sensitivity emulsion layer from the side farther from the support as described in JP-A-59-202464.

Furthermore, an order of high sensitivity emulsion layer/low sensitivity emulsion layer/middle sensitivity emulsion layer or an order of low sensitivity emulsion layer/middle sensitivity emulsion layer/high sensitivity emulsion layer are also employable. In the case where a unit layer is composed of 4 or more layers, the layer arrangement can be altered as described above.

It is desirable for improvement of color reproducibility that an interimage effect-donating layer (CL) having different spectral sensitivity distribution from the main light-sensitive layer such as BL, GL, RL described in U.S. Pat. Nos. 4,663,271, 4,705,744, and 4,707,436, JP-A-62-160448, and JP-A-63-89850 should be provided adjacent or close to the main light-sensitive layer.

As mentioned above, a layer structure or arrangement of light-sensitive materials can be appropriately chosen according to the purpose.

Preferred silver halides used in the photographic emulsion layers of the photographic light-sensitive material which can be used in the present invention include silver iodobromide, silver iodochloride and silver iodochlorobromide each containing not more than about 30 mol% of silver iodide, and more preferably silver iodobromide or silver iodochlorobromide containing silver iodide of from about 2 mol% to about 10 mol%.

Silver halide grains in the photographic emulsions may have a regular crystal form, such as a cubic form, an octahedral form, and a tetradecahedral form; an irregular crystal form, such as a spherical form and a tabular form; a crystal form having a crystal defect, such as a twinning plane; or a composite form thereof.

Silver halide grains may be fine grains of about 0.2 μm or smaller or large grains having a projected area diameter reaching about 10 μm. The silver halide emulsion may be either a poly-dispersed emulsion or a mono-dispersed emulsion.

Silver halide photographic emulsions which can be used in the present invention can be prepared by the processes described, e.g., in *Research Disclosure* (RD), No. 17643 (Dec., 1978), pp. 22–23, "I. Emulsion Preparation and Types", *ibid., No.* 18716 (November, 1979), p. 648, ibid., No. 307105 (November, 1989), pp. 863–865, P. Glafkides, *Chemie et Phisicue Photographique,* Paul Montel (1967), G. F. Duffin, *Photographic Emulsion Chemistry,* Focal Press (1966), and V. L. Zelikman et al., *Making and Coating Photographic Emulsion,* Focal Press (1964).

Mono-dispersed emulsions described in U.S. Pat. Nos. 3,574,628 and 3,655,394 and British Patent 1,413,748 are preferably used as well.

Tabular grains having an aspect ratio of about 3 or more are also useful. Tabular grains can easily be prepared by the processes described, e.g., in Gutoff, *Photographic Science and Engineering,* Vol. 14, pp. 248–257 (1970), U.S. Pat. Nos. 4,434,226, 4,414,310, 4,433,048, and 4,439,520, and British Patent 2,112,157.

The silver halide grains may be homogeneous grains or grains in which the inside and the outer shell have different halogen compositions, or may have a stratiform structure. The grains may have fused thereto silver halide of different halogen composition through epitaxy. The grains may have fused thereto compounds other than silver halides, e.g., silver rhodanide and lead oxide. A mixture comprising grains of various crystal forms is employable.

The above-mentioned emulsions may be of surface latent image type which forms a latent image predominantly on the surface of grains, of internal latent image type which forms a latent image predominantly in the inside of the grains, or of a type which forms a latent image both on the surface and in the inside of the grains, but should be of negative type. Internal latent image type emulsions may be of core/shell type as described in JP-A-63-264740. The core/shell type internal latent image type emulsions can be prepared by the process described in JP-A-59-133542. The thickness of the shell of this type of emulsion preferably ranges from 3 to 40 nm, and particularly from 5 to 20 nm, though varying depending on the development processing.

Silver halide emulsions having been subjected to physical ripening, chemical sensitization, and spectral sensitization are usually used. Additives which can be used in these steps are described in *Research Disclosure,* Nos. 17643, 18716, and 307105 as hereinafter listed.

In the light-sensitive material of the present invention, two or more kinds of emulsions differing in at least one of characteristics including grain size, grain size distribution, halogen composition, grain form, and sensitivity of light-sensitive silver halide emulsion can be used in the same layer.

Surface-fogged silver halide grains described in U.S. Pat. No. 4,082,553, inside-fogged silver halide grains described in U.S. Pat. No. 4,626,498 and JP-A-59-214852, and colloidal silver can be preferably used in light-sensitive silver halide emulsion layers and/or substantially light-insensitive hydrophilic colloidal layers. The terminology "inside- or surface-fogged silver halide grains" as used herein means silver halide grains which are evenly (non-imagewise) developable, exposed or unexposed, without distinction. Methods for preparing inside- or surface-fogged silver halide grains are described in U.S. Pat. No. 4,626,498 and JP-A-59-214852.

The inside core of the inside-fogged core/shell type silver halide grains may have either the same or different halogen composition. The inside- or surface-fogged silver halide may be any of silver chloride, silver chlorobromide, silver iodobromide, and silver chloroiodobromide. While these fogged silver halide grains are not particularly limited in grain size, a preferred mean grain size is from 0.01 to 0.75 μm, and particularly from 0.05 to 0.6 μm. The grain form is not particularly limited and may be regular. The emulsion may be a poly-dispersion but is preferably a mono-dispersion (at least 95% of the weight or number of silver halide grains have a grain size falling within ±40% of a mean grain size).

In the present invention, light-insensitive silver halide fine grains are preferably used. The terminology "light-insensitive silver halide fine grains" means silver halide fine grains which are not sensitive to light of imagewise exposure for obtaining a dye image and are not substantially developed during development processing. It is preferable that such light-insensitive silver halide fine grains are not previously fogged.

The silver halide fine grains have a silver bromide content of from 0 to 100 mol% and may contain, if necessary, silver chloride and/or silver iodide, and preferably have a silver iodide content of from 0.5 to 10 mol%.

The silver halide fine grains preferably have a mean grain size (an average circle-equivalent diameter of the projected area) of from 0.01 to 0.5 μm, and more preferably from 0.02 to 0.2 μm.

The silver halide fine grains can be prepared in the same manner as for general light-sensitive silver halide grains. In this case, the surface of silver halide grains needs to be neither optically sensitized nor spectrally sensitized. It is desirable, however, that a known stabilizer, such as triazole compounds, azaindene compounds, benzothiazolium compounds, mercapto compounds, and zinc compounds, be added before the silver halide grains are added to a coating composition. The layer containing the silver halide fine grains preferably contains colloidal silver.

The light-sensitive material of the present invention preferably has a silver coverage of not more than 6.0 $g/m^2$, and more preferably not more than 4.5 $g/m^2$.

Known photographic additives which can be used in the present invention are described in the above-cited three RDs as tabulated below.

| Additive | RD 17643 | RD 18716 | RD 307105 |
|---|---|---|---|
| 1. Chemical Sensitizer | p. 23 | p. 648, right column | p. 866 |
| 2. Sensitivity Increasing Agent | | p. 648, right column | |
| 3. Spectral Sensitizer, Supersensitizer | pp. 23–24 | p. 648, right column to p. 649, right column | pp. 866–868 |
| 4. Brightening Agent | p. 24 | p. 647, right column | p. 868 |
| 5. Antifoggat, Stabilizer | pp. 24–25 | p. 649, right column | pp. 868–870 |
| 6. Light Absorber, Filter Dye, Ultraviolet Absorber | pp. 25–26 | p. 649, right column to p. 650, left column | p. 873 |
| 7. Stain Inhibitor | p. 25, right column | p. 650, left column to right column | p. 872 |
| 8. Dye Image Stabilizer | p. 25 | p. 650, left column | p. 872 |
| 9. Hardening Agent | p. 26 | p. 651, left column | pp. 874–875 |
| 10. Binder | p. 26 | p. 651, left column | pp. 873–874 |
| 11. Plasticizer, Lubricant | p. 27 | p. 650, right column | p. 876 |
| 12. Coating Aid, Surface Active Agent | pp. 26–27 | p. 650, right column | pp. 875–876 |
| 13. Antistatic Agent | p. 27 | p. 650, right column | pp. 876–877 |
| 14. Matting Agent | | | pp. 878–879 |

In order to prevent deterioration in photographic performance due to formaldehyde gas, a compound capable of reacting with formaldehyde to fix it as described in U.S. Pat. Nos. 4,411,987 and 4,435,503 is preferably added to a light-sensitive material.

The light-sensitive material of the invention preferably contains the mercapto compound described in U.S. Pat. Nos. 4,740,454 and 4,788,132, JP-A-62-18539, and JP-A-1-283551.

The light-sensitive material of the present invention preferably contains a compound capable of releasing a fogging agent, a development accelerator, or a silver halide solvent, or a precursor thereof regardless of a developed silver amount produced by development processing, as described in JP-A-1-106052.

The light-sensitive material of the present invention preferably contains a dye dispersed by the process described in WO 88/04794 and JP-W-1-502912 or the dye described in European Patent 317,308A, U.S. Pat. No. 4,420,555, and JP-A-1-259358.

Various color couplers can be used in the present invention. Specific examples thereof are described in patents cited in *Research Disclosure,* No. 17643, VII-C to G and ibid., No. 307105, VII-C to G.

Examples of suitable yellow couplers are described, e.g., in U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and European Patent 249,473A. Examples of suitable magenta couplers include 5-pyrazolone and pyrazoloazole compounds. Particularly preferred are those described in U.S. Pat. Nos. 4,310,619 and 4,351,897, European Patent 73,636, U.S. Pat. Nos. 3,061,432 and 3,725,064, *Research Disclosure* No. 24220 (Jun., 1984), JP-A-60-33552, *Research Disclosure* No. 24230 (Jun., 1984), JP-A-60-43659, JP-A-61-72238, JP-A-60-35730, JP-A-55-118034, JP-A-60-185951, U.S. Pat. Nos. 4,500,630, 4,540,654, and 4,556,630, and WO 88/04795.

Cyan couplers include phenol and naphthol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent (OLS) No. 3,329,729, European Patents 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658. Pyrazoloazole couplers as described in JP-A-64-553, JP-A-64-554, JP-A-64-555, and JP-A-64-556 and imidazole couplers as described in U.S. Pat. No. 4,818,672 are also useful.

Typical examples of polymerized dye-forming couplers are described in U.S. Pat. Nos. 3,451,820, 4,080,211, 4,367,282, 4,409,320, and 4,576,910, British Patent 2,102,137, and European Patent 341,188A.

Couplers which develop a dye having moderate diffusibility preferably include those described in U.S. Pat. Nos. 4,366,237, British Patent 2,125,570, European Patent 96,570, and West German Patent (OLS) No. 3,234,533.

Colored couplers for correcting unnecessary absorption of a developed dye preferably include those described in *Research Disclosure*, No. 17643, VII-G, ibid, No. 307105, VII-G, U.S. Pat. No. 4,163,670, JP-B-57-39413, U.S. Pat. Nos. 4,004,929 and 4,138,258, and British Patent 1,146,368. Further, couplers capable of releasing a fluorescent dye upon coupling with which unnecessary absorption of a developed dye is corrected as described in U.S. Pat. No. 4,774,181 and couplers having a dye precursor group as a split-off group which is capable of reacting with a developing agent to form a dye as described in U.S. Pat. No. 4,777,120 are preferably used.

Compounds capable of releasing a photographically useful residue on coupling are also preferably used in the present invention. DIR couplers capable of releasing a development inhibitor preferably include, in addition to those according to the present invention, those described in patents cited in RD, No. 17643, VII-F and ibid, No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Bleaching accelerator-releasing couplers described in RD, Nos. 11449 and 24241 and JP-A-61-201247 are effective to reduce the time required for a processing step showing bleaching ability. They produce particularly outstanding effects when added to a light-sensitive material using the above-described tabular silver halide grains.

Couplers capable of imagewise releasing a nucleating agent or a development accelerator at the time of development preferably include those described in British Patents 2,097,140 and 2,131,188, JP-A-59-157638, and JP-A-59-170840. Couplers capable of releasing a fogging agent, a development accelerator, a silver halide solvent, etc. on oxidation-reduction reaction with an oxidation product of a developing agent as described in JP-A-60-107029, JP-A-60-252340, JP-A-1-44940, and JP-A-1-45687 are also preferred.

Additional compounds which can be used in the light-sensitive material of the present invention include competing couplers described, e.g., in U.S. Pat. No. 4,130,427; polyequivalent couplers described, e.g., in U.S. Pat. Nos. 4,283,472, 4,338,393, and 4,310,618; DIR redox compound-releasing couplers, DIR coupler-releasing couplers, DIR coupler-releasing redox compounds, or DIR redox-releasing redox compounds described, e.g., in JP-A-60-185950 and JP-A-62-24252; couplers releasing a dye which restores its color after release described, e.g., in European Patents 173,302A and 313,308A; ligand-releasing couplers described, e.g., in U.S. Pat. No. 4,555,477; couplers releasing a leuco dye described, e.g., in JP-A-63-75747; and couplers releasing a fluorescent dye described, e.g., in U.S. Pat. No. 4,774,181.

The couplers to be used in the present invention can be introduced into a light-sensitive material by various known dispersion methods.

Examples of high-boiling solvents which can be used in an oil-in-water dispersion method are described, e.g., in U.S. Pat. No. 2,322,027. Specific examples of high-boiling organic solvents having a boiling point of 175° C. or higher under atmospheric pressure which can be used in the oil-in-water dispersion method are phthalic acid esters (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthlate), phosphoric or phosphonic esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoic acid esters (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-t-amylphenol), aliphatic carboxylic acid esters (e.g., bis(2-ethylhexyl) sebacate, dioctyl azelate, glycerol tributyrate, isostearyl lactate, trioctyl citrate), aniline derivatives (e.g., N,N-dibutyl-2-butoxy-5-t-octylaniline), and hydrocarbons (e.g., paraffin, dodecylbenzene, diisopropylnaphthalane). Organic solvents having a boiling point of not lower than about 30° C., and preferably from 50° C. to about 160° C. may be used as an auxiliary solvent. Typical examples thereof are ethyl acetate, butyl acetate, ethyl propionate, methyl ethyl ketone, cyclohexanone, 2-ethoxyethyl acetate, and dimethylformamide.

With respect to a latex dispersion method, steps, effects, and specific examples of loadable latices are described, e.g., in U.S. Pat. No. 4,199,363 and West German Patent (OLS) Nos. 2,541,274 and 2,541,230.

The color light-sensitive material of the present invention preferably contains various antiseptics or antifungal agents, such as phenethyl alcohol; and 1,2-benzisothiazolin-3-one, n-butyl p-hydroxybenzoate, phenol, 4-chloro-3,5-dimethylphenol, 2-phenoxyethanol, 2-(4-thiazolyl)benzimidazole, etc. described in JP-A-63-257747, JP-A-62-272248, and JP-A-1-80941.

The present invention can be applied to various color light-sensitive materials, typically including color negative films for general use or for movies, color reversal films for slides or TV, color papers, color positive films, and color reversal papers.

Suitable supports which can be suitably used in the present invention are described, e.g., in RD, No. 17632, p. 28, ibid., No. 18716, p. 647, right column to p. 648, left column, and ibid., No. 307105, p. 879.

In the color light-sensitive materials of the present invention, the hydrophilic colloidal layers on the side having emulsion layers preferably have a total film thickness of not more than 28 μm, more preferably not more than 23 μm, most preferably not more than 18 μm, and particularly not more than 6 μm, and a rate of swelling $T_{\frac{1}{2}}$ of not more than 30 seconds, and more preferably not more than 20 seconds. The terminology "film thickness" means a film thickness as measured after conditioning at 25° C. and a relative humidity of 55% (2 days). A rate of swelling $T_{\frac{1}{2}}$ can be measured in accordance with techniques known in the art. For example, measurements can be made by using a swellometer of the type described in A. Green, et al., *Photogr. Sci. & Eng.*, Vol. 19, No. 2, pp. 124–129. The terminology "rate of swelling $T_{\frac{1}{2}}$" is defined as a time required for a light-sensitive material to be swollen to ½ the saturated swollen thickness, the saturated swollen thickness being defined to be 90% of the maximum swollen thickness which is reached when the light-sensitive material is swollen with a color developing solution at 30° C. for 3 minutes and 15 seconds.

The rate of swelling $T_{\frac{1}{2}}$ can be controlled by addition of a hardening agent to gelatin as a binder or alteration of aging conditions after coating. A degree of swelling preferably ranges from 150 to 400%. A degree of swelling can be calculated from the maximum swollen film thickness under the above-mentioned conditions according to formula: (maximum swollen film thickness - film thickness)/film thickness.

The light-sensitive material of the present invention preferably has a hydrophilic colloidal layer(s) (called backing layer(s)) having a total dry thickness of from 2 to 20 μm on the side opposite to the side having emulsion layers. The backing layers preferably contain the above-described light absorbents, filter dyes, ultraviolet absorbents, antistatic agents, hardening agents, binders, plasticizers, lubricants, coating aids, surface active agents, and so on. The backing layers preferably have a degree of swelling of from 150 to 500%.

The color photographic light-sensitive materials according to the present invention can be development processed by usual methods as described in RD, No. 17643, pp. 28–29, ibid., No. 18716, p. 615, left to right columns, and ibid., No. 307105, pp. 880–881.

A color developing solution to be used for development processing of the light-sensitive material of the present invention is preferably an alkaline aqueous solution containing an aromatic primary amine color developing agent as a main component. As color developing agents, while aminophenol compounds are useful, p-phenylenediamine compounds are preferably used. Typical examples thereof are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and sulfates, hydrochlorides or p-toluenesulfonates thereof. Particularly preferred of them is 3-methyl-4-amino-N-ethyl-N-β-hydroxyethylaniline sulfate. Two or more of these compounds may be used in combination according to the purpose.

The color developing solution usually contains pH buffering agents, e.g., carbonates, borates or phosphates of alkali metals, and development inhibitors or antifoggants, e.g., chlorides, bromides, iodides, benzimidazoles, benzothiazoles, and mercapto compounds. If necessary, the color developing solution further contains various preservatives, such as hydroxylamine, diethylhydroxylamine, sulfites, hydrazines, e.g., N,N-biscarboxymethylhydrazine, phenyl semicarbazides, triethanolamine, and catecholsulfonic acids; organic solvents, e.g., ethylene glycol and diethylene glycol; development accelerators, e.g., benzyl alcohol, polyethylene glycol, quaternary ammonium salts, and amines; dye-forming couplers; competing couplers; auxiliary developing agents, e.g., 1-phenyl-3-pyrazolidone; viscosity-imparting agents; and various chelating agents, such as aminopolycarboxylic acids, aminopolyphosphonic acids, alkylphosphonic acids, and phosphonocarboxylic acids, e.g., ethylenediaminetetraacetic acid, nitrilotriacetic acid, ethylenetriaminepentaacetic acid, cyclohexanediaminetetraacetic acid, hydroxyethyliminodiacetic acid,1-hydroxyethylidene-1,1-diphosphonicacid,nitrilo-N,N,N-trimethylenephosphonic acid, ethylenediamine-N,N,N,N-tetra-methylenephosphonic acid, ethylenediamine-di(o-hydroxyphenylacetic acid), and salts thereof.

In case of carrying out reversal processing, color development is generally preceded by black-and-white development. A black-and-white developing solution contains known black-and-white developing agents, such as dihydroxybenzenes, e.g., hydroquinone, 3-pyrazolidones, e.g., 1-phenyl-3-pyrazolidone, and aminophenols, e.g., N-methyl-p-aminophenol, either individually or in combination thereof. These color developing solution and black-and-white developing solution generally have a pH between 9 and 12. A rate of replenishment for these developing solutions, though varying depending on the kind of a color photographic light-sensitive material to be processed, is usually not more than 3 l per $m^2$ of a light-sensitive material. It can be reduced to 500 ml/$m^2$ or less by reducing a bromide ion concentration in the replenisher. When a rate of replenishment is reduced, it is desirable to prevent evaporation and aerial oxidation of a solution by minimizing a contact area of the processing tank with air.

The contact area of a photographic processing solution in a processing tank with air can be expressed in terms of opening ratio defined below.

$$\text{Opening Ratio} = [\text{Contact Area (cm}^2\text{) of Processing Solution with Air}] \div [\text{Volume (cm}^3\text{) of Processing Solution}]$$

The opening ratio as defined above is preferably not more than 0.1, and more preferably between 0.001 and 0.05. The opening ratio can be so reduced by putting a barrier, such as a floating cover, on the liquid surface of a processing tank, using a movable cover as described in JP-A-1-82033, or utilizing slit development processing as described in JP-A-63-216050. Reduction of an opening ratio is preferably applied to not only color development and black-and-white development but also all the subsequent steps, such as bleach, blix, fixing, washing, and stabilization. Reduction of a rate of replenishment may also be achieved by using a means for suppressing accumulation of a bromide ion in a developing solution.

A time of color development processing is usually from 2 to 5 minutes. The processing time may be shortened by conducting development processing at an elevated temperature and an increased pH in an increased concentration of the color developing agent.

Photographic emulsion layers after color development are usually subjected to bleach. Bleach may be carried out either simultaneously with fixing (blix), or bleach and fixing may be carried out separately. For speeding up of processing, bleach may be followed by blix. Further, the processing may be arbitrarily carried out according to the purpose by using two tanks of blix bath connected, or conducting fixing before blix, or conducting bleach after blix. Bleaching agents to be used include compounds of polyvalent metals, e.g., iron (III), peracids, quinones, and nitroso compounds. Typical bleaching agents include organic complex salts of iron (III), such as complex salts with aminopolycarboxylic acids, e.g., ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid; citric acid, tartaric acid, or malic acid. Preferred of them are aminopolycarboxylic acid iron (III) complexes, e.g., (ethylenediaminetetraacetato)iron (III) complex salts and (1,3-diaminopropanetetraacetato)iron (III) complex salts, from the standpoint of rapidness of processing and prevention of environmental pollution. Aminopolycarboxylic acid iron (III) complex salts are particularly useful either in a bleaching bath or in a blix bath. A bleaching bath or blix bath containing these aminopolycarboxylic acid iron (III) complex salts usually has a pH between 4.0 and 8. A lower pH is also employed for rapid processing.

If necessary, a fixing bath, a blix bath, or a prebath thereof may contain known bleaching accelerators. Specific examples of useful bleaching accelerators are described in the following specifications, including compounds having a mercapto group or a disulfide group described, e.g., in U.S. Pat. No. 3,893,858, German Patents 1,290,812 and 2,059,988, JP-A-53-2736, JP-A-53-57831, JP-A-53-37418, JP-A-53-72623, JP-A-53-5630, JP-A-53-95631, JP-A-53-104232, JP-A-53-124424, JP-A-53-141623, JP-A-53-28426, and *Research Disclosure,* No. 17129 (Jul., 1978); thiazolidine derivatives described in JP-A-50-140129; thiourea deivatives described in JP-B-45-8506, JP-A-52-20832, JP-A-53-32735, and U.S. Pat. No. 3,706,561; iodides described in West German Patent 1,127,715 and JP-A-58-16235; polyoxyethylene compounds described in German Patents 966,410 and 2,748,430; polyamine compounds described in JP-B-45-8836; and, in addition, compounds described in JP-A-49-40943, JP-A-49-59644, JP-A-53-94927, JP-A-54-35727, JP-A-55-26506, and JP-A-58-163940; and a bromide ion. Among them, compounds having a mercapto group or a disulfide group are preferred because of their high accelerating effect. The compounds disclosed in U.S. Pat. No. 3,893,858, West German Patent 1,290,812, and JP-A-53-95630 are particularly preferred. In addition, the compounds disclosed in U.S. Pat. No. 4,552,834 are also preferred. These bleaching accelerators may be incorporated into a light-sensitive material. The bleaching accelerators are particularly effective for blix of color light-sensitive materials for photographing.

For the purpose of preventing bleach stain, the bleaching or blix bath preferably contains organic acids. Particularly preferred organic acids are compounds having an acid dissociation constant (pKa) of from 2 to 5, specifically including acetic acid, propionic acid, and hydroxyacetic acid.

Fixing agents which can be used in a fixing or blix bath include thiosulfates, thiocyanates, thioether compounds, thioureas, and a large quantity of an iodide, with thiosulfates being commonly employed. In particular, ammonium thiosulfate is widely useful. A combined use of a thiosulfate and a thiocyanate, a thioether compound, a thiourea, etc. is also preferred. Preservatives for the fixing or blix bath preferably include sulfites, bisulfites, carbonyl-bisulfite adducts, and sulfinic acid compounds described in European Patent 294769A. For the purpose of stabilization of processing solutions, the fixing or blix bath preferably contains various aminopolycarboxylic acids or organophosphonic acids.

In the present invention, the fixing or blix bath preferably contains 0.1 to 10 mol/l of a compound having a pKa of from 6.0 to 9.0 for pH adjustment, preferably imidazoles, e.g., imidazole, 1-methylimidazole, 1-ethylimidazole, and 2-methylimidazole.

The total time of desilvering is preferably as short as possible as long as insufficient desilvering does not result. A preferred desilvering time is from 1 to 3 minutes, and more preferably from 1 to 2 minutes. The processing temperature is from 25° to 50° C., and preferably from 35° to 45° C. In the preferred temperature range, the rate of desilvering is improved, and stain formation after processing is effectively prevented.

It is desirable that stirring is reinforced as much as possible during the desilvering step. Specific methods for achieving reinforced stirring include a method in which a jet stream of a processing solution is made to strike against the emulsion surface of a light-sensitive material as described in JP-A-62-183460; a method of using a rotating means to enhance stirring effects as described in JP-A-62-183461; a method in which a light-sensitive material is moved with its emulsion surface being in contact with a wire blade placed in a processing solution to make turbulence; and a method of increasing a total flow of a circulating processing solution. These stirring means are effective in any of a bleaching bath, a blix bath and a fixing bath. Reinforced stirring appears to accelerate supply of a bleaching agent or a fixing agent to emulsion layers and, as a result, to increase the rate of desilvering. The above-described means for reinforced stirring is more effective in the case where a bleaching accelerator is used, markedly enhancing acceleration effects and eliminating the fixing inhibitory effect of the bleaching accelerator.

An automatic processor which can be used for processing the light-sensitive material of the present invention preferably has a means for carrying a light-sensitive material as described in JP-A-60-191257, JP-A-60-191258, and JP-A-60-191259. As mentioned in JP-A-60-191257 supra, such a carrying means is highly effective to considerably reduce carry-over of a processing solution from one bath into a succeeding bath thereby to prevent deterioration of processing performance. Such an effect is particularly effective for reduction of a processing time or a replenishment rate in each processing step.

After desilvering processing, the silver halide color photographic material of the present invention is generally subjected to washing and/or stabilization. The amount of washing water to be used in the washing step is selected from a broad range depending on characteristics of the light-sensitive material (e.g., the kind of photographic materials such as couplers), the end use, the temperature of washing water, the number of washing tanks (the number of stages), the replenishing system, e.g., countercurrent-flow system or concurrent-flow system, and other various conditions. A relation between the number of washing tanks and the quantity of water in a multi-stage countercurrent-flow system can be obtained by the method described in *Journal of the Society of Motion Picture and Television Engineers,* Vol. 64, pp. 248–253 (May, 1955).

According to the multi-stage countercurrent-flow system disclosed in the above literature, while the amount of water can be greatly reduced, there arise problems such that bacteria grow with an increase in water retention time in the tank, and the produced suspended matter adheres to light-sensitive materials. As a counter measure against such problems, a method of reducing calcium and magnesium ions described in JP-A-62-288838 can be used with extreme effectiveness. Further, isothiazolone compounds or thiabendazole compounds described in JP-A-57-8542, chlorine type bactericides, e.g., chlorinated sodium isocyanurate, and bactericides described in Horiguchi Hiroshi, *Bokin bobaizai no kaqaku,* Sankyo Shuppan (1986), Eisei Gijutsukai (ed.), *Biseibutsu no mekkin, sakkin, bobai qijutsu* Kogyo Gijutsukai (1982), and Nippon Bokin Bobai Gakkai (ed.), *Bokin bobaizai jiten* (1986), e.g., benzotriazole, can also be used.

Washing water to be used in the processing the light-sensitive material according to the present invention has a pH between 4 and 9, and preferably between 5 and 8. A washing temperature and a washing time, though varying depending on the characteristics or the end use of the light-sensitive material, and the like, are usually 20 seconds to 10 minutes at 15° to 45° C., and preferably from 30 seconds to 5 minutes at 25° to 40° C. The light-sensitive material of the present invention may be processed directly with a stabilizer in place of the above-described washing. In such a stabilization processing, any of known techniques described in JP-A-57-8543, JP-A-58-148344, and JP-A-60-220345 can be utilized.

In some cases, washing is followed by stabilization. For example, a stabilizing bath containing a dye stabilizer and a surface active agent, which is used as a final bath for color light-sensitive materials for photographing, is used. Dye stabilizers include aldehydes, e.g., formalin and glutaraldehyde, N-methylol compounds, hexamethylenetetramine, and an aldehyde-sulfite adduct. The stabilizing bath may also contain various chelating agents and antifungal agents. An overflow accompanying replenishment for washing and/or stabilization may be reused in other processing steps, such as a desilvering step.

In cases where each processing solution is concentrated by vaporization during processing with an automatic processor, etc., water is preferably supplied for correction of concentration.

For the purpose of simplification and speeding up of processing, the silver halide color light-sensitive material of the present invention may contain therein a color developing agent. For incorporation, a color developing agent is preferably used in the form of a precursor thereof. Examples include indoaniline compounds described in U.S. Pat. No. 3,342,597, Schiff base compounds described in U.S. Pat. No. 3,342,599 and *Research Disclosure,* Nos. 14850 and 15159, aldol compounds described in *Research Disclosure,* No. 13924, metal salt complexes described in U.S. Pat. No. 3,719,492, and urethane compounds described in JP-A-53-135628.

If necessary, the silver halide color light-sensitive material of the present invention may further contain therein various 1-phenyl-3-pyrazolidone compounds for the purpose of accelerating color development. Typical compounds are described in JP-A-56-64339, JP-A-57-144547, and JP-A-58-11543.

Each of the processing solutions is used in the present invention at 10° to 50° C. and, in a standard manner, at 33° to 38° C. Higher temperatures may be employed for reducing a processing time, or lower temperatures may be employed for improving image quality or stability of the processing solution.

The silver halide light-sensitive material of the present invention is also applicable to heat-developable light-sensitive materials described in U.S. Pat. No. 4,500,626, JP-A-60-133449, JP-A-59-218443, JP-A-61-238056, and European Patent 10,660A2.

EXAMPLES

The present invention is now illustrated in greater detail by way of Examples, but the present invention is not limited thereto.

EXAMPLE 1

A multi-layer color light-sensitive material (Sample 101) comprising a cellulose triacetate film support having thereon layers having the following respective compositions was prepared.

Composition of Light-Sensitive Layers

The coverage was expressed in terms of gram of silver per $m^2$ as for silver halide and colloidal silver; gram per $m^2$ as for couplers, additives, and gelatin; and number of moles per mol of silver halide in the respective layers as for sensitizing dyes.

| | |
|---|---|
| **1st Layer (Antihalation Layer)** | |
| Black colloidal silver | 0.15 |
| Gelatin | 1.00 |
| ExM-8 | 0.02 |
| **2nd Layer (Interlayer)** | |
| Gelatin | 1.20 |
| UV-1 | 0.03 |
| UV- | 0.06 |
| UV-3 | 0.07 |
| ExF-1 | 0.004 |
| Solv-2 | 0.07 |
| **3rd Layer (Low Sensitivity Red-Sensitive Emulsion Layer)** | |
| Silver iodobromde emulsion (AgI: 10 mol %; inside high AgI type; sphere-equivalent diameter: 0.3 μm; coefficient of fluctuation of sphere-coequivalent diameter: 19%; normal crystal-twin mixed grains; diameter/thickness ratio: 5.5) | Ag coverage: 0.35 |
| Gelatin | 1.0 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.22 |
| ExC-4 | 0.010 |
| Solv-1 | 0.007 |
| **4th Layer (Middle Sensitivity Red-Sensitive Emulsion Layer)** | |
| Silver iodobromide emulsion (AgI: 14 mol %; inside high AgI type; sphere-equivalent diameter: 0.55 μm; coefficient of fluctuation of sphere-equivalent diameter: 20%; normal crystal-twin mixed grains; diameter/thickness ratio: 2.0) | Ag coverage: 0.60 |
| Gelatin | 1.05 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.33 |
| ExC-4 | 0.005 |
| ExY-14 | 0.008 |
| ExY-13 | 0.02 |
| ExC-2 | 0.08 |
| Cpd-10 | $1.0 \times 10^{-4}$ |
| Solv-1 | 0.10 |
| **5th Layer (High Sensitivity Red-Sensitive Emulsion Layer)** | |
| Silver iodobromide emulsion (AgI: 14 mol %; inside high AgI type; sphere-equivalent diameter: 0.7 μm; coefficient of fluctuation of sphere-equivalent diameter: 19%; twin mixed grains; diameter/thickness ratio: 6) | Ag coverage: 0.70 |
| Gelatin | 0.90 |
| ExS-1 | $1.0 \times 10^{-4}$ |
| ExS-2 | $3.0 \times 10^{-4}$ |
| ExS-3 | $1.0 \times 10^{-5}$ |
| ExC-5 | 0.07 |
| ExC-6 | 0.08 |
| Solv-1 | 0.15 |
| Solv-2 | 0.08 |
| **6th Layer (Interlayer)** | |
| Gelatin | 0.60 |
| P-2 | 0.05 |
| Cpd-1 | 0.10 |
| Cpd-4 | 0.17 |
| Solv-1 | 0.05 |
| **7th Layer (Low Sensitivity Green-Sensitive Emulsion Layer)** | |
| Silver iodobromide emulsion (AgI: 2 mol %; inside high AgI type; | Ag coverage: 0.25 |

-continued

| | |
|---|---|
| sphere-equivalent diameter: 0.3 μm; coefficient of fluctuation of sphere-equivalent diameter: 28%; normal crystal-twin mixed grains; diameter/thickness ratio: 2.5) | |
| Gelatin | 0.40 |
| ExS-4 | $5.0 \times 10^{-4}$ |
| ExS-6 | $0.3 \times 10^{-4}$ |
| ExS-5 | $2.0 \times 10^{-5}$ |
| ExM-9 | 0.2 |
| ExY-13 | 0.03 |
| ExM-8 | 0.03 |
| Solv-1 | 0.2 |
| 8th Layer (Middle Sensitivity Green-Sensitive Emulsion Layer) | |
| Silver iodobromide emulsion (AgI: 4 mol %; inside high AgI type; sphere-equivalent diameter: 0.55 μm; coefficient of fluctuation of sphere-equivalent diameter: 20%; normal crystal-twin mixed grains; diameter/thickness ratio: 4) | Ag coverage: 0.35 |
| Gelatin | 0.90 |
| ExS-4 | $5.0 \times 10^{-4}$ |
| ExS-5 | $2.0 \times 10^{-4}$ |
| ExS-6 | $0.3 \times 10^{-5}$ |
| ExM-9 | 0.25 |
| ExM-8 | 0.03 |
| ExM-10 | 0.015 |
| ExY-13 | 0.04 |
| Solv-1 | 0.2 |
| 9th Layer (High Sensitivity Green-Sensitive Emulsion Layer) | |
| Silver iodobromide emulsion (AgI: 10 mol %; inside high AgI type; sphere-equivalent diameter: 0.7 μm; coefficient of fluctuation of sphere-equivalent diameter: 30%; normal crystal-twin mixed grains; diameter/thickness ratio: 2.0) | Ag coverage: 0.50 |
| Gelatin | 0.80 |
| ExS-4 | $2.0 \times 10^{-4}$ |
| ExS-5 | $2.0 \times 10^{-4}$ |
| ExS-6 | $0.2 \times 10^{-4}$ |
| ExS-7 | $3.0 \times 10^{-4}$ |
| ExM-11 | 0.06 |
| ExM-12 | 0.02 |
| ExM-8 | 0.02 |
| Cpd-2 | 0.01 |
| Cpd-9 | $2.0 \times 10^{-4}$ |
| Cpd-10 | $2.0 \times 10^{-4}$ |
| Solv-1 | 0.20 |
| Solv-2 | 0.05 |
| 10th Layer (Yellow Filter Layer) | |
| Gelatin | 0.50 |
| Yellow colloidal silver | 0.02 |
| Cpd-1 | 0.18 |
| Solv-1 | 0.15 |
| 11th Layer (Low Sensitivity Blue-Sensitive Emulsion Layer) | |
| Silver iodobromide emulsion (AgI: 4 mol %; inside high AgI type; sphere-equivalent diameter: 0.5 μm; coefficient of fluctuation of sphere-equivalent diameter: 15%; octahedral grains) | Ag coverage: 0.35 |
| Gelatin | 1.0 |
| ExS-8 | $2.0 \times 10^{-4}$ |
| ExY-15 | 0.85 |
| ExY-13 | 0.09 |
| Cpd-2 | 0.01 |
| Solv-1 | 0.28 |
| 12th Layer (High Sensitivity Blue-Sensitive Emulsion Layer) | |
| Silver iodobromide emulsion (AgI: 10 mol %; inside high AgI type; sphere-equivalent diameter: 1.3 μm; coefficient of fluctuation of sphere-equivalent diameter: 25%; normal crystal-twin mixed grains; diameter/thickness ratio: 4.5) | Ag coverage: 0.45 |
| Gelatin | 0.50 |
| ExS-8 | $1.0 \times 10^{-4}$ |
| ExY-15 | 0.12 |
| Cpd-2 | 0.001 |

-continued

| | |
|---|---|
| Cpd-5 | $2.0 \times 10^{-4}$ |
| Solv-1 | 0.04 |
| 13th Layer (1st Protective Layer) | |
| Silver iodobromide fine grains (mean grain size: 0.05 μm; AgI: 4 mol %) | 0.07 |
| Gelatin | 0.8 |
| UV-2 | 0.1 |
| UV-3 | 0.1 |
| UV-4 | 0.2 |
| Solv-3 | 0.04 |
| 14th Layer (2nd Protective Layer) | |
| Gelatin | 0.70 |
| Polymethyl methacrylate particles (diameter: 1.5 μm) | 0.18 |
| H-1 | 0.35 |

In addition, Cpd-3, Cpd-5, Cpd-6, Cpd-7, Cpd-8, P-2, W-1, W-2, and W-3 were added for improvements of preservability, processability, pressure resistance, antifungal and antibacterial properties, antistatic properties, and coating properties, and the above 14 layers were coated simultaneously. The dry film thickness was 16.0 μm.

Samples 102 to 111

Sample 102 was prepared by adding comparative coupler C-1 to the 3rd and 4th layers of Sample 101 in an amount of 0.025 g/m$^2$ and 0.040 g/m$^2$, respectively. Samples 103 to 111 were prepared by replacing C-1 of Sample 102 with a comparative compound and the compound represented by formula (I) according to the present invention. The kind and amount of the compound added (at a molar ratio, taking C-1 as 1.0) are shown in Table 1. These amounts were decided so as to give a substantial agreement of gamma values (gradation).

Each of the samples was imagewise exposed to white light and subjected to the following color development processing. Results of photographic performance obtained are shown in Table 1 together with an RMS value (a value of a cyan image at an aperture of 48 μm diameter) indicative of graininess. With respect to sharpness, the samples were processed in the same manner and evaluated by a common MTF method. Further, the samples were imagewise exposed to white light in the same manner and, after allowed to stand under accelerated aging conditions of 45° C. and relative humidity of 80% for 14 days, subjected to the same development processing. Furthermore, the samples were imagewise exposed through a red filter (SC-62 produced by Fuji Photo Film Co., Ltd.) and then uniformly exposed through a green filter (BPN-45 produced by Fuji Photo Film Co., Ltd.) at 0.05 CMS, and the exposed samples were development processed. A value obtained by subtracting a magenta density at a cyan fog density from a magenta density at a cyan density of 1.5 is shown in Table 1 as a degree of color turbidity.

Color development processing was carried out as follows at 38° C. with an automatic processor.

| | |
|---|---|
| Color Development | 2 minutes and 35 seconds |
| Bleach | 1 minute |
| Blix | 3 minutes and 15 seconds |
| Washing (1) | 40 seconds |
| Washing (2) | 1 minute |
| Stabilization | 40 seconds |

-continued

| | |
|---|---|
| Drying (50° C.) | 1 minute and 15 seconds |

In the above processing steps, washing steps (1) and (2) were conducted in a countercurrent-flow washing system from (2) to (1). The composition of each processing solution is described below.

The rate of replenishment of the processing solution was 1200 ml for color development and 800 ml for other steps inclusive of washing each per $m^2$ of the color light-sensitive material. A carry-over of the processing bath into the washing step was 50 ml per $m^2$ of the color light-sensitive material.

Color Developing Solution:

| | Running Solution | Replenisher |
|---|---|---|
| Diethylenetriaminepentaacetic acid | 1.0 g | 1.1 g |
| 1-Hydroxyethylidene-1,1-diphosphonic acid | 2.0 g | 2.2 g |
| Sodium sulfite | 4.0 g | 4.4 g |
| Potassium carbonate | 30.0 g | 32.0 g |
| Potassium bromide | 1.4 g | 0.7 g |
| Potassium iodide | 1.3 mg | — |
| Hydroxylamine sulfate | 2.4 g | 2.6 g |
| 4-(N-Ethyl-N-β-hydroxyethylamino)-2-methylaniline sulfate | 4.5 g | 5.0 g |
| Water to make (unit: liter) | 1.0 | 1.0 |
| pH | 10.0 | 10.05 |

Bleaching Bath (common to running solution and replenisher):

| | |
|---|---|
| Ammonium (ethylenediaminetetraacetato)-iron (III) | 120.0 g |
| Disodium ethylene diaminetetraacetate | 10.0 g |
| Ammonium nitrate | 10.0 g |
| Ammonium bromide | 100.0 g |
| Bleaching accelerator (compound represented by formula shown below) | $5 \times 10^{-3}$ mol |
| Aqueous ammonia to adjust to | pH 6.3 |
| Water to make | 1.0 liter |

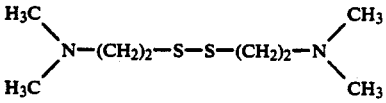

Blix Bath (common to running solution and replenisher):

-continued

| | |
|---|---|
| Ammonium (ethylenediaminetetraacetato)iron II | 50.0 g |
| Disodium ethylenediaminetetraacetate | 5.0 g |
| Sodium sulfite | 12.0 g |
| Ammonium thiosulfate aqueous solution (700 g/liter) | 240 ml |
| Aqueous ammonia to adjust to | pH 7.3 |
| Water to make | 1 liter |

Washing Water:

Tap water containing 32 mg/liter of a calcium ion and 7.3 mg/liter of a magnesium ion was passed through a column packed with an H-type strongly acidic cation exchange resin and an OH-type strongly basic anion exchange resin to reduce calcium and magneisum ions to 1.2 mg/liter and 0.4 mg/liter, respectively. To the thus treated water was added 20 mg/liter of sodium isocyanurate dichloride.

Stabilizer (common to running solution and replenisher):

| | |
|---|---|
| Formalin (37 w/v %) | 2.0 ml |
| Polyoxyethylene-p-monononyl phenyl ether (average degree of polymerization: 10) | 0.3 g |
| Disodium ethylenediaminetetraacetate | 0.05 g |
| Water to make | 1 liter |
| pH | 5.8 |

Drying:

The drying temperature was set at 50° C.

TABLE 1

| Sample No. | Compound Added to 3rd & 4th Layers Kind | Amount | RMS (×1000) | MTF 25 cycle/mm Cyan Image | Degree of Color Turbidity | 45° C., 80%, 14 days Change in Fog* | Change in Sensitivity** |
|---|---|---|---|---|---|---|---|
| 101 (Comparison) | — | 0 | 26.6 | 0.55 | 0.03 | +0.02 | −0.06 |
| 102 (Comparison) | C-1 | 1.0 | 24.8 | 0.68 | −0.09 | +0.07 | −0.17 |
| 103 (Comparison) | C-2 | 1.2 | 25.2 | 0.69 | −0.10 | +0.06 | −0.15 |
| 104 (Comparison) | C-3 | 0.60 | 24.2 | 0.60 | −0.05 | +0.06 | −0.14 |
| 105 (Comparison) | C-4 | 0.80 | 24.5 | 0.62 | −0.09 | +0.07 | −0.18 |
| 106 (Comparison) | C-5 | 0.30 | 24.0 | 0.65 | −0.09 | +0.05 | −0.15 |
| 107 (Invention) | (1) | 0.50 | 23.1 | 0.74 | −0.14 | +0.03 | −0.08 |
| 108 (Invention) | (2) | 0.40 | 22.8 | 0.73 | −0.13 | +0.02 | −0.07 |
| 109 (Invention) | (3) | 0.30 | 22.6 | 0.73 | −0.13 | +0.02 | −0.07 |
| 110 (Invention) | (4) | 0.60 | 23.0 | 0.75 | −0.15 | +0.02 | −0.07 |
| 111 (Invention) | (9) | 0.40 | 22.9 | 0.73 | −0.15 | +0.03 | −0.08 |

*Change in fog of cyan density, an increase being indicated with +.
**Relative value of a logarithm of an exposure giving cyan density (fog + 0.2), an increase being indicated with +.

It is apparent from Table 1 that the samples of the present invention are excellent in color reproducibility as being expressed in terms of degree of color turbidity, excellent in sharpness expressed in terms of MTF value and graininess expressed in terms of RMS value, and less liable to fluctuations in photographic properties under severe conditions of 45° C. and 80%.

EXAMPLE 2

Sample 201 was prepared in the same manner as for Sample of JP-A-1-214849, except by adding to the 3rd, 4th, and 5th layers 0.010 g/$m^2$, 0.010 g/$m^2$, and 0.008 g/$m^2$, respectively, of Compound (1) of the present invention, and adding to the 6th and 7th layers 0.015 g/$m^2$ and 0.010 g/$m^2$, respectively, of Compound (32) of the present invention. In the similar manner, Samples 202 to 206 were prepared. Each sample was irradiated with soft X-rays at an aperture of 500 μm×4 mm or 15 μm×4 mm, and a ratio of the cyan color density at the center was obtained to evaluate an edge effect. The results obtained are shown in Table 2.

TABLE 2

| Sample No. | Compound Added to 3rd, 4th & 5th Layers Kind | Amount*) | Compound Added to 6th & 7th layers Kind | Amount**) | Cyan Density Ratio 15 μm × 4 mm/500 μm × 4 mm |
|---|---|---|---|---|---|
| 201 (Invention) | (1) | 1.0 | (32) | 1.0 | 1.58 |
| 202 (Invention) | (18) | 1.6 | " | " | 1.57 |
| 203 (Invention) | (23) | 1.0 | (30) | 1.0 | 1.58 |

TABLE 2-continued

| Sample No. | Compound Added to 3rd, 4th & 5th Layers Kind | Amount*) | Compound Added to 6th & 7th layers Kind | Amount**) | Cyan Density Ratio 15 μm × 4 mm/500 μm × 4 mm |
|---|---|---|---|---|---|
| 204 (Invention) | (24) | 1.8 | " | " | 1.57 |
| 205 (Comparison) | C-2 | 3.0 | — | 0 | 1.38 |
| 206 (Comparison) | C-5 | 0.8 | — | 0 | 1.42 |

*)At a molar ratio, taking Compound (1) as 1.0.
**)At a molar ratio, taking Compound (32) as 1.0.

It can be seen from Table 2 that the samples of the present invention are obviously excellent in edge effect, i.e., sharpness.

Development was conducted through the following processing steps using the following processing solutions and an automatic processor for motion picture film. Samples under test were subjected to processing after an imagewise exposed sample had been processed until a cumulative amount of a replenisher for a color developing solution reached three times the volume of the tank of the running solution.

Processing Steps

| Step | Processing Time | Processing Temp. | Rate of Replenishment* | Tank Volume |
|---|---|---|---|---|
| Color development | 3'15" | 38.0° C. | 23 ml | 15 l |
| Bleach | 50" | 38.0° C. | 5 ml | 5 l |
| Blix | 50" | 38.0° C. | — | 5 l |
| Fixing | 50" | 38.0° C. | 16 ml | 5 l |
| Washing (1) | 30" | 38.0° C. | — | 3 l |
| Washing (2) | 20" | 38.0° C. | 34 ml | 3 l |
| Stabilization | 20" | 38.0° C. | 20 ml | 3 l |
| Drying | 1' | 55° C. | | |

*Amount per m of a 35 mm wide film

Washing was conducted in a countercurrent-flow system from (2) to (1). All the washing overflow was introduced into the fixing bath. Replenishment was conducted in such a manner that the top of a bleaching tank was connected to the bottom of a blix tank and the top of a fixing tank was connected to the bottom of a blix tank through pipes so as to introduce all the overflow resulting from supply of replenishers to the bleaching tank and the fixing tank to the blix bath. The carry-over of a developing solution into the bleaching step, the carry-over of a bleaching bath to the blix step, the carry-over of a blix bath to the fixing step, and the carry-over of the fixing bath to the washing step were 2.5 ml, 2.0 ml, 2.0 ml, and 2.0 ml, respectively, each per m of a 35 mm wide light-sensitive material. Each cross-over time was 5 seconds, which time was included in the processing time of the preceding step. In each processing bath, a jet stream of the processing solution was made to strike against the emulsion surface of a light-sensitive material according to the method described in JP-A-62-183460.

Compositions of the processing solutions are shown below.

Color Developing Solution:

| | Running Solution (g) | Replenisher (g) |
|---|---|---|
| Diethylenetriaminepentaacetic acid | 2.0 | 2.2 |
| 1-Hydroxyethylidene-1,1-diphosphonic acid | 3.3 | 3.3 |
| Sodium sulfite | 3.9 | 5.2 |
| Potassium carbonate | 37.5 | 39.0 |

-continued

| | | |
|---|---|---|
| Potassium bromide | 1.4 | 0.4 |
| Potassium iodide | 1.3 mg | — |
| Hydroxylamine sulfate | 2.4 | 3.3 |
| 2-Methyl-4-[N-ethyl-N-β-hyroxyethyl)amino]aniline sulfate | 4.5 | 6.1 |
| Water to make (unit: liter) | 1.0 | 1.0 |
| pH | 10.05 | 10.15 |

Bleaching Bath:

| | Running Solution | Replenisher |
|---|---|---|
| Ammonium (1,3-propylenediaminetetraacetato)iron (III) monohydrate | 144.0 | 206.0 |
| Ammonium bromide | 84.0 | 120.0 |
| Ammonium nitrate | 17.5 | 25.0 |
| Hydroxyacetic acid | 63.0 | 90.0 |
| Acetic acid | 33.2 | 47.4 |
| Water to make (unit: liter) | 1.0 | 1.0 |
| pH (adjusted with aqueous ammonia) | 3.20 | 2.80 |

Blix Bath Running Solution:

A 15:85 mixture of the above-described bleaching bath running solution and the following fixing bath running solution.

Fixing Bath:

| | Running Solution (g) | Replenisher (g) |
|---|---|---|
| Ammonium sulfite | 19.0 | 57.0 |
| Ammonium thiosulfate aqueous solution (700 g/liter) | 280 ml | 840 ml |
| Imidazole | 28.5 | 85.5 |
| Ethylenediaminetetraacetic acid | 12.5 | 37.5 |
| Water to make (unit: liter) | 1.0 | 1.0 |
| pH (adjusted with aqueous ammonia and acetic acid) | 7.40 | 7.45 |

Washing Water (common to running solution and replenisher):

Tap water was passed through a mxied bed column packed with an H-type strongly acidic cation exchange resin (Amberlite IR-120B, produced by Rohm & Haas) and an OH-type strongly basic anion exchange resin (Amberlite IRA-400, produced by Rohm & Haas) to reduce calcium and magnesium ions each to 3 mg/liter or less, and 20 mg/liter of sodium isocyanurate dichloride and 150 mg/liter of sodium sulfate were added therto. The thus treated water had a pH between 6.5 and 7.5.

Stabilizer (common to running solution and replenisher): (unit: g)

| | |
|---|---|
| Formalin (37%) | 2.0 ml |
| Polyoxyethylene-p-monononyl phenyl ether (average degree of polymerization: 10) | 0.3 |
| Disodium ethylenediaminetetraacetate | 0.05 |
| Water to make | 1 liter |
| pH | 5.0–8.0 |

EXAMPLE 3

To the 4th layer of Sample 101 of JP-A-1-243056 was added $5\times10^{-5}$ mol/m$^2$ of Compound (1), (8), (11), (47), or (48) of the present invention, and the samples were evaluated in the same manner as in Examples 1 and 2. It was confirmed, as a result, that addition of the compounds of the present invention provides light-sensitive materials excellent in color reproducibility, graininess, sharpness, and preservability.
Chemical structures or chemical names of the compounds used in the present invention are shown below.
UV-1:
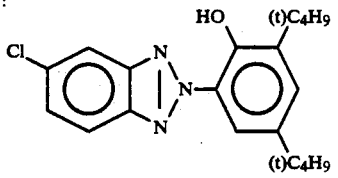
UV-2:
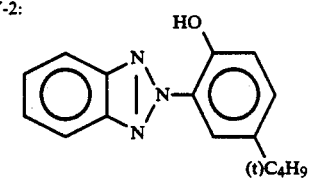
UV-3:
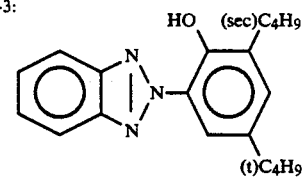
UV-4:
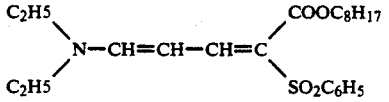
Solv-1: Tricresyl phosphate
Solv-2: Dibutyl phthalate
Solv-3: Tri(2-ethylhexyl) phosphate
ExF-1:
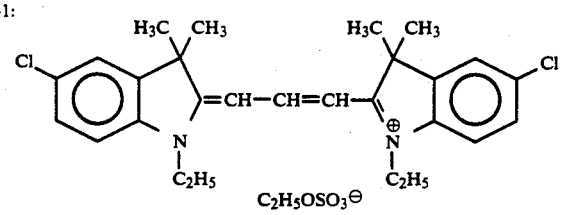
ExC-2:
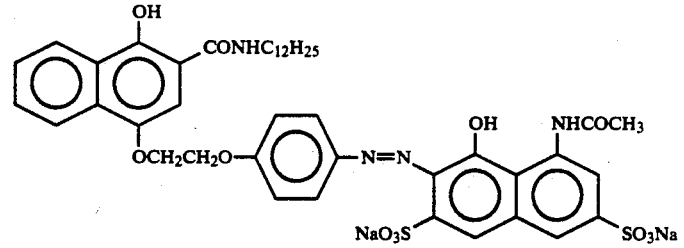
ExC-3:
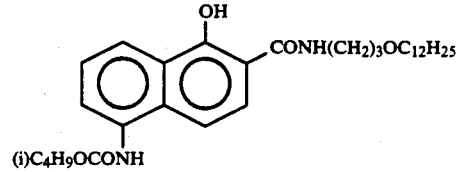

-continued
ExC-4:
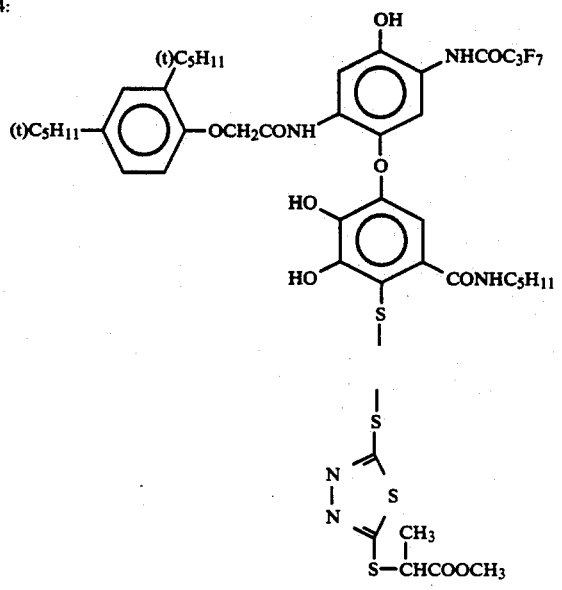
ExC-5:
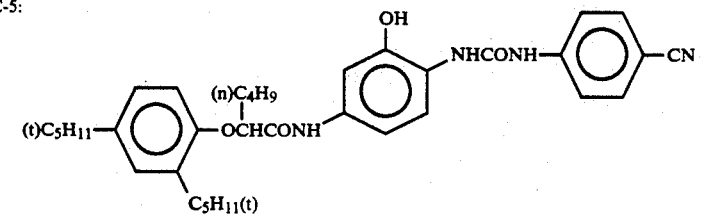
ExC-6:
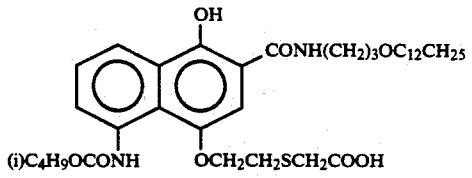
ExM-8:
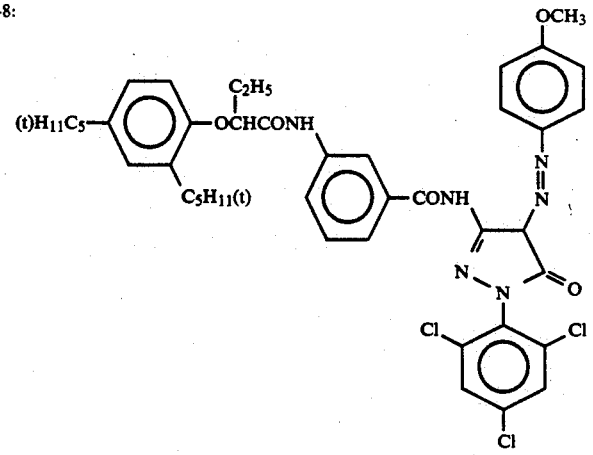

-continued
ExM-9:
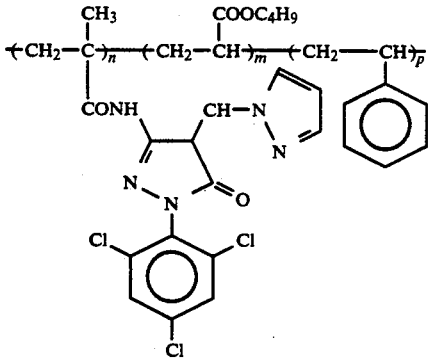
n/m/p = 50/25/25 (by weight)
Molecular Weight = about 20,000
ExM-10:
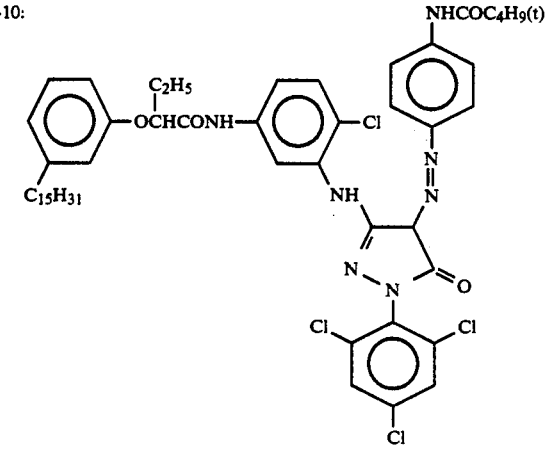
ExM-11:
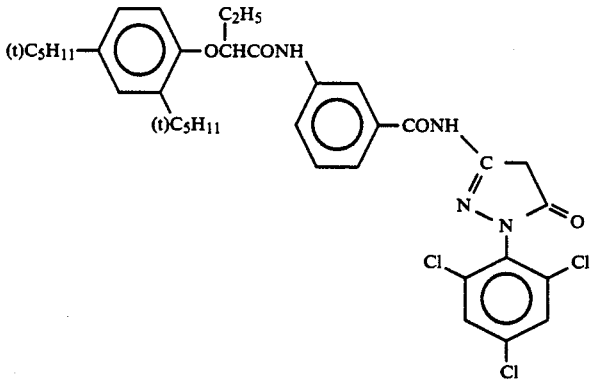
ExM-12:
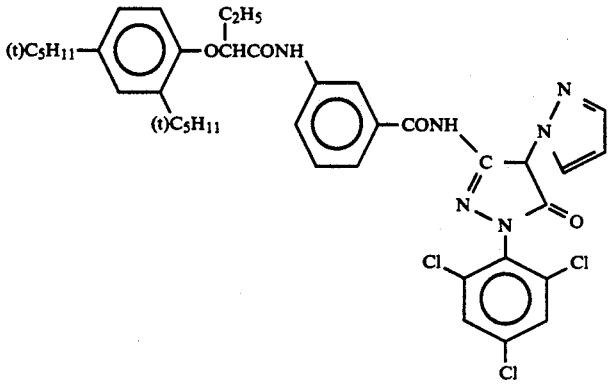

-continued
ExY-13:
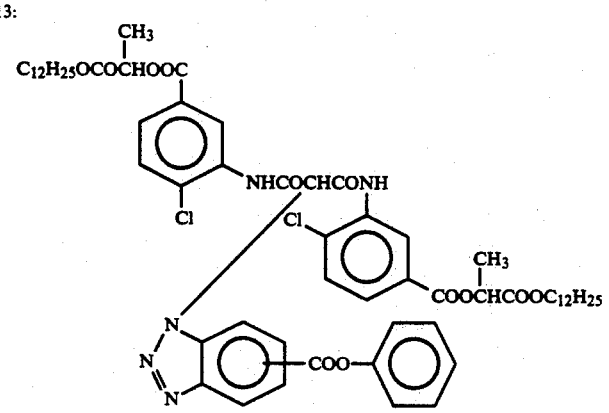
ExY-14:
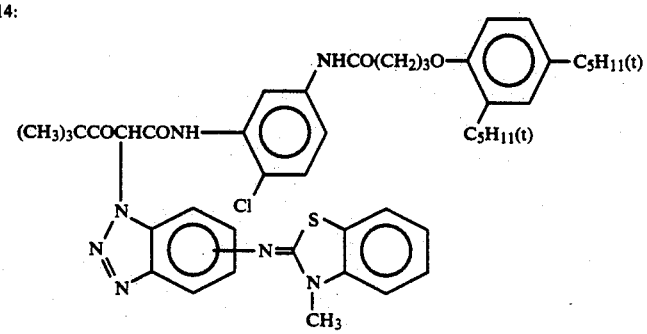
ExY-15:
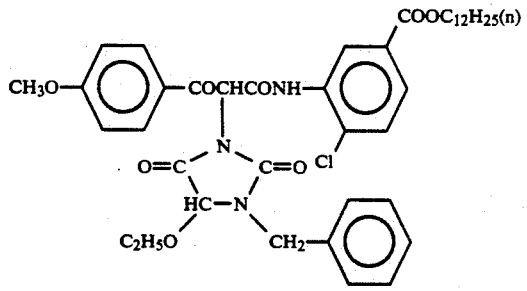
Cpd-1:
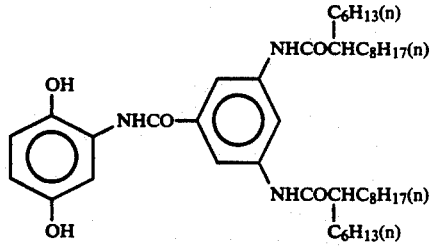
Cpd-2:
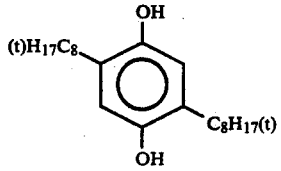

-continued
ExS-1:
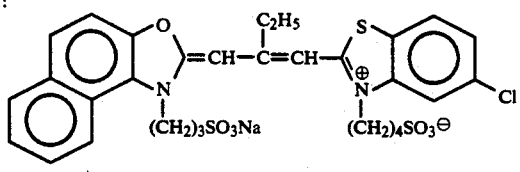
ExS-2:
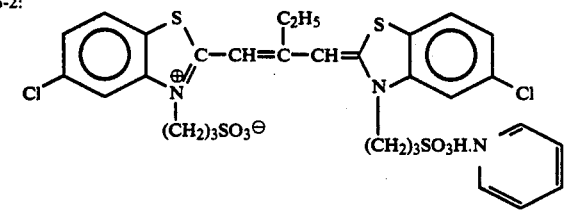
ExS-3:
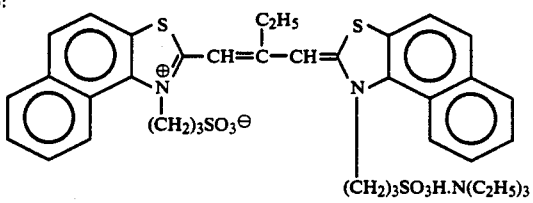
ExS-4:
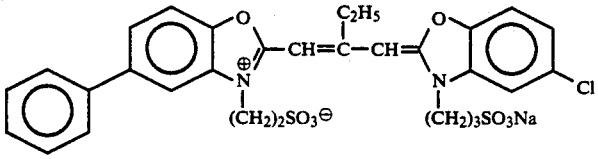
ExS-5:
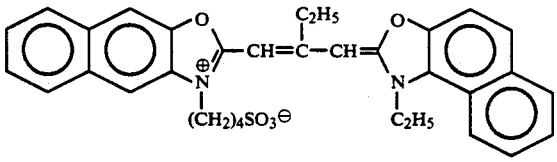
ExS-6:
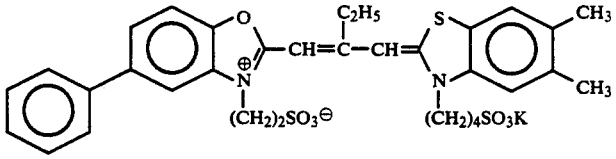
ExS-7:
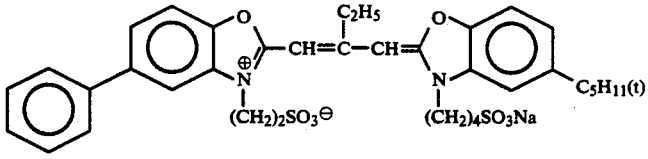
ExS-8:
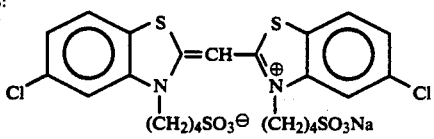
H-1:
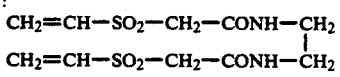

-continued
Cpd-3:
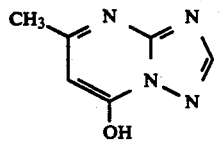
Cpd-4:
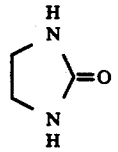
Cpd-5:
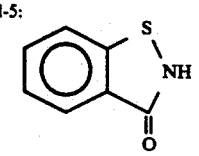
Cpd-6:
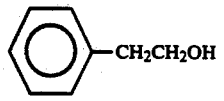
Cpd-7:
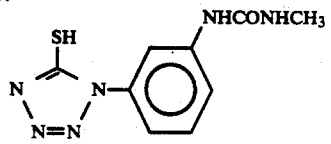
Cpd-8:
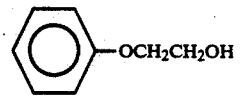
Cpd-9:
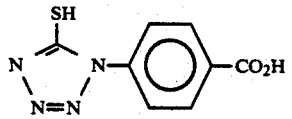
Cpd-10:
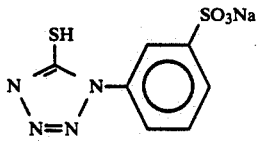
Cpd-11:
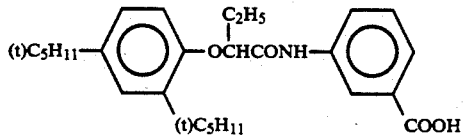
W-1:
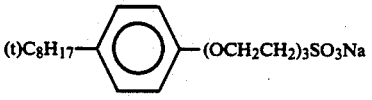
W-2:
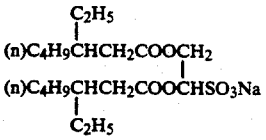
W-3: $C_8F_{17}SO_2N(C_3H_7)CH_2COOK$
P-1: Vinylpyrrolidone-vinyl alcohol copolymer (copolymerization ratio = 70:30 by weight)
P-2: Polyethyl acrylate
C-1: (Coupler (19) of JP-A-60-218645)
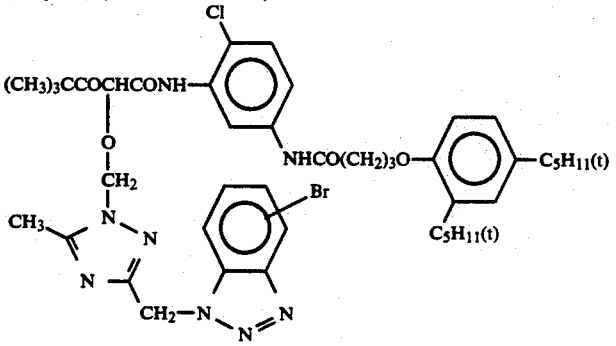

-continued
C-2: (Coupler (1) of JP-A-60-249148)
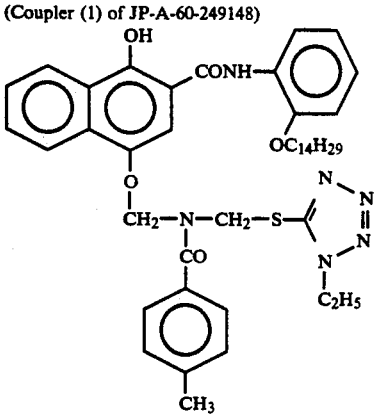
C-3: (Coupler (26) of JP-A-61-156127)
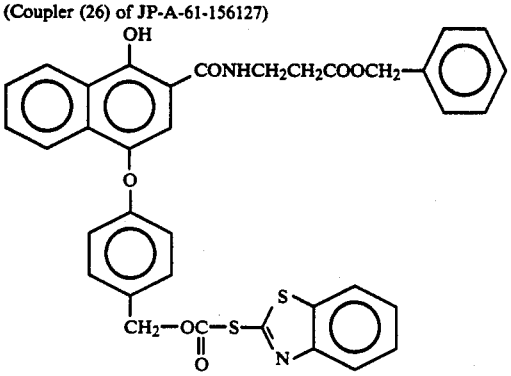
C-4: (Compound 5 of U.S. Pat. No. 4,861,701)
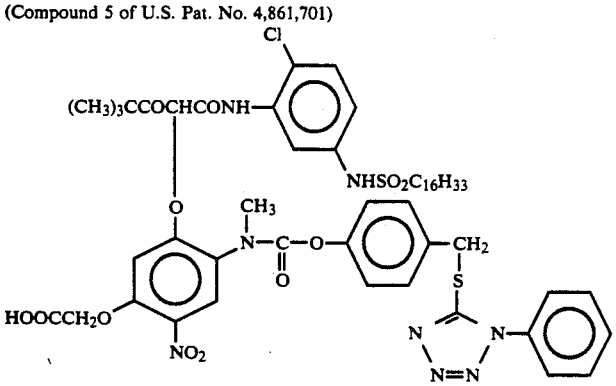
C-5: (Compound 17 of European Patent 354,532A)
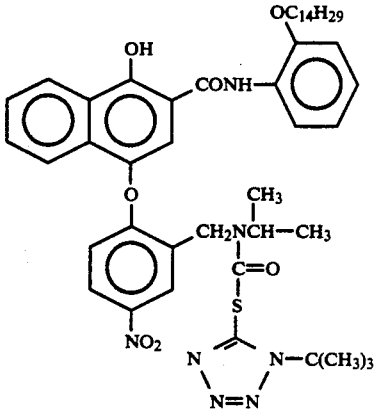

EFFECT OF THE INVENTION

By using the compound represented by formula (I) according to the present invention, there is provided a silver halide color photographic material which is excellent in sharpness and graininess and less liable to fluctuations of photographic properties during aging after photographing (exposure) up to development.

What is claimed is:

1. A silver halide color photographic material comprising a support having provided thereon at least one silver halide emulsion layer, wherein the silver halide color photographic material contains a compound represented by the following formula (I):

$$A—L_1—L_2—INH—Q \quad (I)$$

wherein

A represents a coupler residue having a non-diffusible group;

$L_1$ represents *—$OCH_2$—** or

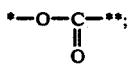

wherein * represents the position bonded to A and ** represents the position bonded to $L_2$;

$L_2$ represents a group capable of releasing INH-Q through electron transfer along a conjugated system and is any of the groups represented by the following formulae:

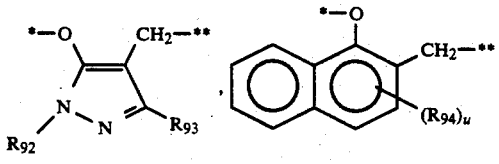

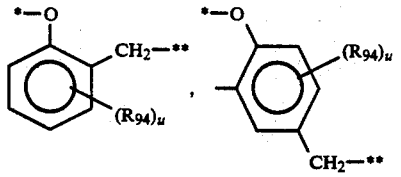

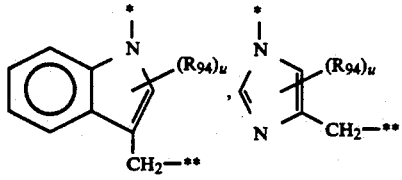

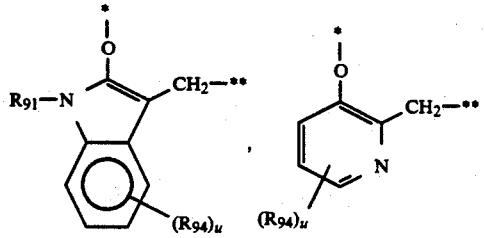

-continued

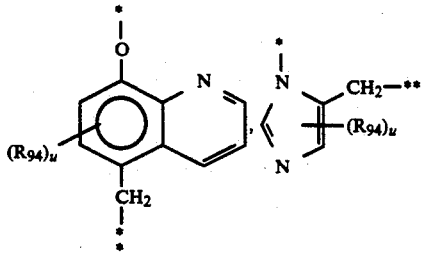

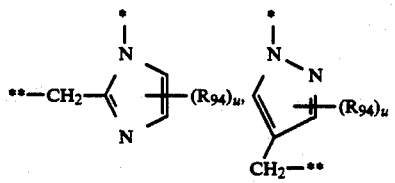

where $R_{91}$ represents an alkyl group or an aryl group; $R_{92}$ represents an alkyl group, an aryl group, an acyl group, a sulfonyl group, or an alkoxycarbonyl group; $R_{93}$ represents a hydrogen atom, an alkyl group, an aryl group, an alkoxycarbonyl group, a nitro group, a cyano group, a halogen atom, an alkoxy group, an aryloxy group, a carbamoyl group, a sulfamoyl group, an acylamino group, a sulfonylamino group, an amino group, an alkylthio group, or an arylthio group; $R_{94}$ represents any of the groups represented by $R_{93}$ except for a hydrogen atom; and u represents 0, 1, or 2; with u being 2, two $R_{94}$ groups may be the same or different wherein * represents the position bonded to $L^1$ and ** represents the position bonded to INH-Q;

INH represents a development inhibitor residue connected to $L_2$ at the hetero atom thereof and is any of the groups represented by the following formulae (INH-1) to (INH-13);

(INH-1)

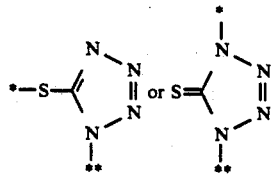

(INH-2)

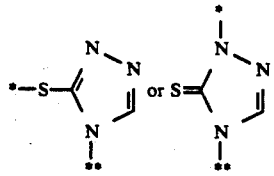

(INH-3)

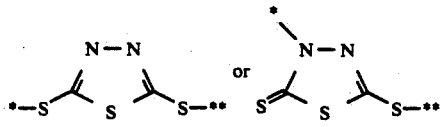

(INH-4)

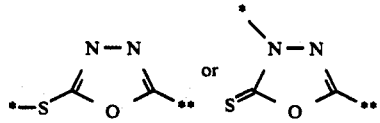

-continued (INH-5)

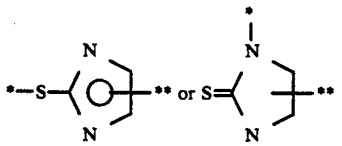

(INH-6)

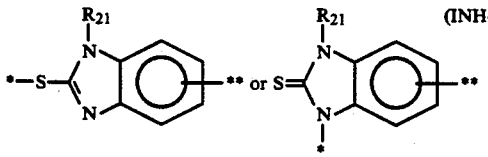

wherein $R_{21}$ represents a hydrogen atom, a substituted or unsubstituted hydrocarbon group (INH-7)

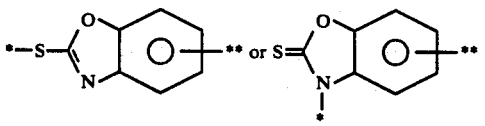

(INH-8)

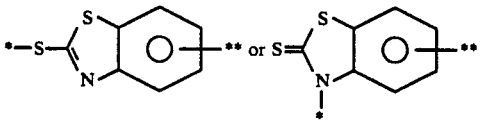

(INH-9)

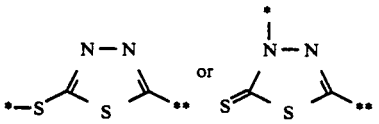

(INH-10)

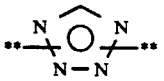

(INH-11)

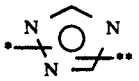

-continued (INH-12)

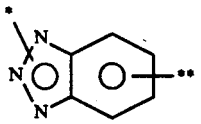

(INH-13)

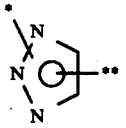

wherein * represents the position bonded to $L_2$ and ** represents the position bonded to Q; and Q represents a secondary or tertiary alkyl group having from 3 to 5 carbon toms, provided that when Q has a substituent(s), the total carbon atom number may exceed 5.

2. The silver halide color photographic material as claimed in claim 1, wherein the compound of formula (I) is present in a light-sensitive silver halide emulsion layer.

3. The silver halide color photographic material as claimed in claim 2, wherein the light-sensitive silver halide emulsion layer is a red-sensitive silver halide emulsion layer.

4. The silver halide color photographic material as claimed in claim 2, wherein the compound of formula (I) is present in an amount of $3\times10^{-7}$ to $1\times10^{-3}$ mol/$m_2$.

5. The silver halide color photographic material as claimed in claim 2, wherein the compound of formula (I) is present in an amount of $1\times10^{-5}$ to $2\times10^{-4}$ mol/$m^2$.

6. A silver halide color photographic material as claimed in claim 1, wherein Q is an unsubstituted secondary or tertiary alkyl group having from 3 to 5 carbon atoms.

7. A silver halide color photographic material as claimed in claim 1, wherein INH is any of groups represented by formulae (INH-1), (INH-2), (INH-3), (INH-4), (INH-9), and (INH-12).

8. A silver halide color photographic material as claimed in claim 1, wherein INH is a group represented by formula (INH-1).

9. A silver halide color photographic material as claimed in claim 1, wherein $L_2$ is one of the groups which contain a nitrogen atom bonded to $L_1$.

* * * * *